US012604971B2

(12) United States Patent
Jackson

(10) Patent No.: US 12,604,971 B2
(45) Date of Patent: Apr. 21, 2026

(54) ATTACHMENT SYSTEM HAVING SPLAYED STRANDS

(71) Applicant: Amer Sports Canada Inc., North Vancouver (CA)

(72) Inventor: Daniel White Jackson, Vancouver (CA)

(73) Assignee: Amer Sports Canada Inc., North Vancouver (CA)

( * ) Notice: Subject to any disclaimer, the term of this patent is extended or adjusted under 35 U.S.C. 154(b) by 800 days.

(21) Appl. No.: 17/950,302

(22) Filed: Sep. 22, 2022

(65) Prior Publication Data

US 2024/0099447 A1 Mar. 28, 2024

(51) Int. Cl.

| | |
|---|---|
| ***A45F 5/02*** | (2006.01) |
| ***A45F 3/04*** | (2006.01) |
| ***A45F 3/14*** | (2006.01) |

(52) U.S. Cl.

CPC ..... *A45F 5/02* (2013.01); *A45F 3/04* (2013.01); *A45F 2003/146* (2013.01)

(58) Field of Classification Search

CPC ..... A45F 5/02; A45F 3/04; A45F 2003/146
See application file for complete search history.

(56) References Cited

U.S. PATENT DOCUMENTS

| | | | |
|---|---|---|---|
| 3,263,289 | A | 8/1966 | LaGarde |
| 3,450,810 | A | 6/1969 | LaGarde |
| 4,121,688 | A | 10/1978 | Lirakis |
| 4,687,074 | A | 8/1987 | Green |
| 5,145,027 | A | 9/1992 | Petzl et al. |
| 5,433,289 | A | 7/1995 | O'rourke |
| 5,615,750 | A | 4/1997 | Phillips |
| 5,957,091 | A | 9/1999 | McDonald et al. |
| 6,283,248 | B1 | 9/2001 | Grover |
| 6,431,313 | B1 | 8/2002 | Petzl et al. |
| 6,874,596 | B2 | 4/2005 | Zeissler et al. |
| 7,445,085 | B2 | 11/2008 | Petzl et al. |
| 7,490,510 | B2 | 2/2009 | Agami et al. |
| 7,490,610 | B2 | 2/2009 | Franklin |
| 7,743,885 | B2 | 6/2010 | Martin et al. |
| 8,025,192 | B2 | 9/2011 | Petzl et al. |
| 8,292,029 | B2 | 10/2012 | Martin |
| 8,333,262 | B1 | 12/2012 | Carpentel et al. |

(Continued)

FOREIGN PATENT DOCUMENTS

| | | |
|---|---|---|
| EP | 3111998 | 12/2021 |
| EP | 3006089 | 3/2022 |

(Continued)

*Primary Examiner* — Travis M Figg
(74) *Attorney, Agent, or Firm* — Terence P. O'Brien; Todd A. Rathe

(57) ABSTRACT

An attachment system may include a panel and a flexible length of strands. The panel has a first face, a second face, an edge between the first face and the second face, and an opening extending through and non-parallel to the first face and the second face. The flexible length of strands extends through the opening. The flexible length of strands includes a first portion of the length comprising bundled portions of the strands extending along the first face and a second portion of the flexible length comprising splayed portions of the strands extending from the first portion along the second face. The splayed portions of the strands are bonded to the second face.

22 Claims, 12 Drawing Sheets

(56) References Cited

U.S. PATENT DOCUMENTS

| | | | | |
|---|---|---|---|---|
| 9,003,617 | B2 | 4/2015 | Walker et al. | |
| 10,143,865 | B2 | 12/2018 | Franke et al. | |
| 10,143,965 | B1 | 12/2018 | Gunugunuri et al. | |
| 10,646,025 | B2 | 5/2020 | Koren | |
| 10,933,260 | B2 | 3/2021 | Nance et al. | |
| 11,311,755 | B2 | 4/2022 | Blondeau | |
| 2007/0209869 | A1* | 9/2007 | Martin | D03D 15/587 182/6 |
| 2008/0125295 | A1* | 5/2008 | Ingram | A63B 21/4021 2/161.1 |
| 2008/0229558 | A1 | 9/2008 | Martin | |
| 2011/0284321 | A1 | 11/2011 | Hall et al. | |
| 2016/0096044 | A1* | 4/2016 | Franke | A62B 35/0025 57/22 |
| 2016/0344437 | A1 | 11/2016 | Gordon | |
| 2017/0074351 | A1 | 3/2017 | Benavidez et al. | |
| 2018/0289084 | A1 | 10/2018 | Li | |
| 2020/0009411 | A1 | 1/2020 | Antonio | |
| 2020/0108294 | A1 | 4/2020 | Nance et al. | |
| 2021/0178200 | A1 | 6/2021 | Power, II et al. | |
| 2022/0007768 | A1* | 1/2022 | Morgan | A41F 3/04 |

FOREIGN PATENT DOCUMENTS

| | | |
|---|---|---|
| GB | 2283935 | 5/1995 |
| WO | WO9111318 | 8/1991 |

* cited by examiner

ATTACHMENT SYSTEM HAVING SPLAYED STRANDS

BACKGROUND

Garments, packs and other articles formed from generally flat flexible sheets or panels of material are often provided with attachments or mechanisms for attaching other items to the articles. For example cords or straps are often attached to garments, packs and other articles, wherein accessories or articles may be secured about the cord or strap. Backpacks frequently include what are known as Molle connectors for connecting various Molle accessories.

Figure 1:
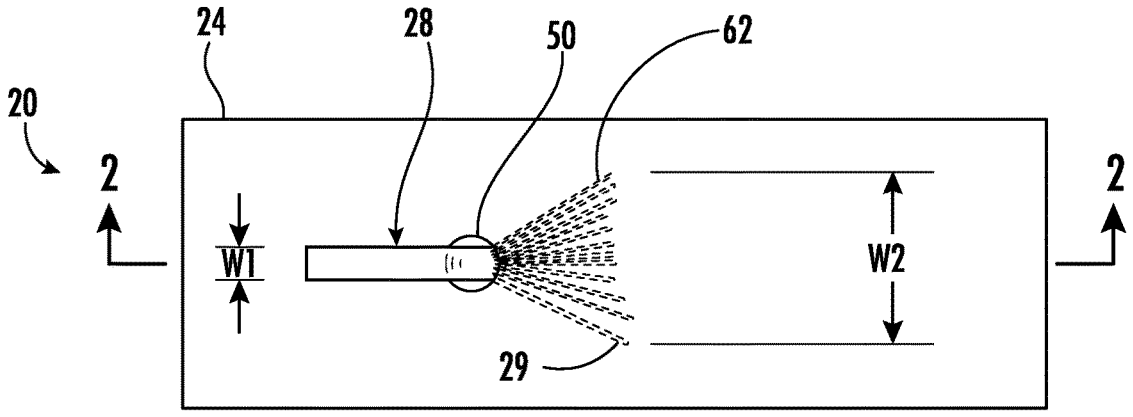
FIG. 1 is a top view of portions of an example attachment system having strands with portions that are bundled and portions that are splayed.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example attachment systems that facilitate the connection of various attachments or accessories to a garment, pack or other article. The disclosed attachment systems utilize a flexible length of strands having a first portion of bundled strands on a first side of a panel for connection to an attachment or accessory and a second portion of splayed strands bonded to a second side of the panel. The disclosed attachment systems are less complex and less costly as compared to existing attachment systems. The disclosed attachment systems offer a strong attachment mechanism with a flatter profile.

The flexible length of strands passes through an opening in the panel. As a result, the splayed strands may be located on a back face of the panel, concealed, while the bundled strands extend along a front face of the panel, accessible for the attachment of accessories to the bundled strands. In some implementations, the bundled strands extend opposite to the first or front face of the panel, along the front face of the panel which provides a back surface behind the bundled strands. In some implementations, the front face of the panel cooperates with the bundled strands to form an opening or closed loop for receiving an accessory between the bundled strands and the front face of the panel.

The splayed strands may comprise individual strands that are splayed or fanned out from the bundled strands. The flexible length of strands providing the first portion of bundled strands and the second portion of splayed strands may comprise a strap, a cord or rope. The strap, cord or rope may be elastic or inelastic. The bundled strands may be woven, braided, wound, twisted and/or wrapped. In some implementations, the flexible length of may have at least one additional outer coating or sheath about the first portion of bundled strands. For example, the flexible length of strands may be part of a kernmantle rope with a sheath about the strands, which may or may not themselves be woven, braided, wound, bonded, or twisted. In some implementations, the bundled strands may comprise tow that is wrapped or bundled by an outer covering or sheath. The portion of the flexible length of strands providing the splayed strands may have the sheath or coating removed. In some implementations, each individual strand of the splayed strands may comprise an individual fiber or group of fibers. In some implementations, each individual strand of the splayed strands may be part of a sub-bundle of fibers or strands bound together by an outer sheath or wrap, or a sub-bundle of strands that are twisted, woven, bonded, and/or braided together.

In some implementations, the splayed strands may form an end of the flexible length of strands, each of the strands of the splayed strands terminating at an end. In some implementations, the splayed strands may be provided as an intermediate portion of the flexible length of strands, the intermediate portion of splayed strands extending between first and second portions of bundled strands. For example, a single flexible length of strands may have individual strands that are first bundled (woven, braided, wound or wrapped), that are then diverged or splayed (unbundled and fanned apart), and that are then once again converged together. The converged strands may be bundled (once again woven, braided, wound or wrapped) or may remain unbundled, but located in close proximity to one another, having a maximum width less than the maximum width of the splayed portion of the strands.

The splayed strands extend opposite to and across a larger surface area of the panel as compared to a width of the bundled portion of the flexible length of strands. This larger surface area provides a stronger connection to the panel and offers a flatter profile across the face of the panel. In some implementations, the first bundled portion of the flexible length of strands has a maximum width lying in a first plane, on a first side of the panel, parallel to the first face the panel (diameter of a cylinder or transverse width of a flat band), wherein the second portion of splayed strands extending from the first bundled portion has a second maximum width lying in a second plane, on a second side of the panel, parallel to the first plane, that is greater than the first maximum width. The second maximum width is defined as the largest width of the fan of splayed strands, the spacing between two of the splayed strands that are spread apart from one another by the largest distance. In some implementations, the second maximum width is at least five times the first maximum width. In some implementations, the second maximum width is at least 20 times the first maximum width.

The splayed strands may be bonded, directly or indirectly, to the second face or back face of the panel in various different fashions with a bonding layer. In some implementations, the bonding layer may comprise a film or layer of adhesive that is coated, adhered to or otherwise applied to the second face of the panel, wherein the splayed strands are placed in contact with the layer of adhesive. In some implementations, the bonding layer may comprise a liquid or fluid adhesive that is applied to the second face of the panel, wherein the fluid adhesive encapsulates the splayed strands prior to solidifying or curing. In some implementations, the bonding layer may comprise a film or other layer that is bonded or adhered to the second face with the splayed strands being captured or sandwiched between the bonding layer and the second face of the panel. In some implementations, the bonding layer may comprise a film or tape having two sides of adhesive, wherein a first adhesive side is adhered to the second face of the panel and a second adhesive side is adhered to the splayed strands. In some implementations, the splayed strands may be bonded to the second face of the panel using multiple (two or more) bonding layers, a first bonding layer may be directly adhered to the second face of the panel and a second bonding layer adhered to the first bonding layer with the splayed strands captured or sandwiched between the first and second bonding layers. In some implementations, the bonding layer may comprise a portion of the panel that is in an adhesive or bonding state at the time it is brought into contact with the splayed strands. For example, the second face of the panel may be melted or in a fluid state when the splayed strands are brought into contact with the second face, wherein curing or solidification of second face forms a bonding layer adhered to less than all of the sides of the individual splayed strands or encapsulating (extending completely about) each of the individual splayed strands.

The disclosed attachment system facilitates the provision of retainer loops or loop connectors at various locations, wherein such locations are not limited to being adjacent to a seam of a pack, garment or article. Such retainer loops or loop connectors may be provided directly on the surfaces of shoulder straps, on outdoor clothing such as fishing vests, tactical vests, hunting vests, pants or any other garment where a connection point may be desired. Such loop connectors do not require stitching or additional metal grommets, fasteners, or the like. As result, such loop connectors may be less expensive and may offer a lower profile, being dead flat to the material of the panel. The loop connectors are less obtrusive and less visible as compared to other existing connection mechanisms, facilitating their use on dressier outdoor clothing, handbags and the like.

In some implementations, the flexible length of strands may comprise an 8 mm braid or weave of material such as nylon. The panel may be formed from a material such as a nylon, polyester, VECTRAN™, DYNEEMA™, or mesh type fabric. The panel may also be for from other materials such as polymers or the like. In such implementations, the splaying of the individual strands may be achieved using a wire brush or similar mechanism. In some implementations, the junction between the bundled portions of the strands and the splayed portion strands may be basted or secured with pressure sensitive adhesive (PSA) to reduce unwanted unraveling of the bundled strands portions.

Disclosed is an attachment system that may include a panel and a flexible length of strands. The panel has a first face, a second face, an edge between the first face and the second face, and an opening extending through and non-parallel to the first face and the second face. The flexible length of strands extends through the opening. The flexible length of strands includes a first portion of the length comprising bundled portions of the strands extending along the first face and a second portion of the flexible length comprising splayed portions of the strands extending from the first portion along the second face. The splayed portions of the strands are bonded to the second face.

In some implementations, the flexible length of strands further comprises a third portion comprising splayed strands extending from the first portion on a side of the first portion opposite the second portion, the third portion extending along the second face and sandwiched between the second face and the bonding layer. In some implementations, the panel comprises a second opening extending through and nonparallel to the first face and the second face, wherein the first portion of extends over and across portions of the first face between the opening and the second opening.

In some implementations, the panel comprises a third opening extending through and nonparallel to the first face and the second face and a fourth opening extending through and nonparallel to the first face and the second face, wherein the attachment system further comprises a second flexible length of strands extending through the third opening and through the fourth opening and wherein the second flexible length of strands comprises a fourth portion comprising bundled strands along the first face and extending parallel to the first portion the flexible length of strands, the fourth portion and the first portion forming first and second aligned openings, respectively, extending parallel to the first face, a fifth portion comprising splayed strands, extending from the fourth portion and extending along the second face, and a sixth portion comprising splayed strands, extending from of the fifth portion on a side of the fourth portion opposite the fifth portion. A second bonding layer may be laminated to the second face with the splayed strands of the fourth portion being sandwiched between the second bonding layer and the second face.

Figure 36:
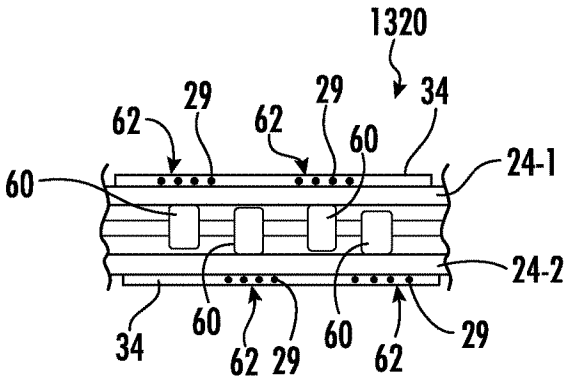
FIG. 36 is an end view of the example attachment system of FIG. 35 taken along line 36-36.
Figure 35:
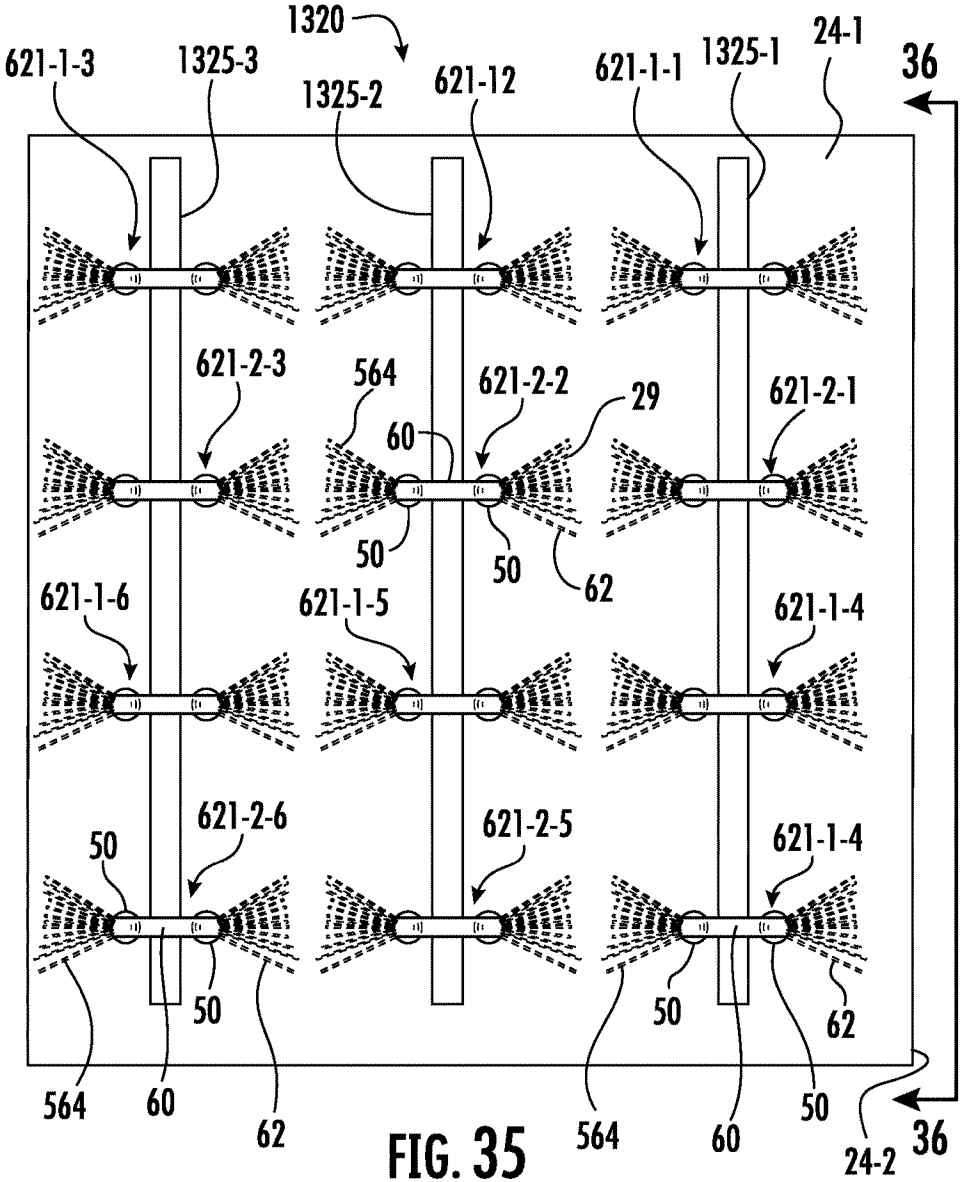
FIG. 35 is a top view of portions of an example attachment system.

Referring to FIGS. 35 and 36, in some implementations, the bonding layer and the second bonding layer are part of a continuous bonding layer. In some implementations, a strap may pass through the first and second aligned openings. In some implementations, the system may further comprise a second panel having a third face, a fourth face, a second edge between the third face and the fourth face, fifth opening extending through and non-parallel to the third face and the fourth face, and a sixth opening extending through and non-parallel to the third face and the fourth face, a third flexible length of strands extending through the fifth opening and the sixth opening. The third flexible length of strands may comprise a seventh portion comprising bundled strands along the third face and forming a third opening extending parallel to the first face, an eighth portion comprising splayed strands extending from the seventh portion and along the fourth face and a ninth portion comprising splayed strands extending from the seventh portion on a side of the seventh portion opposite the eighth portion, the ninth portion extending along the fourth face. A third bonding layer may be laminated to the fourth face with the splayed strands of the eight portion and the ninth portion sandwiched between the third bonding layer and the fourth face, wherein the strap passes through the third opening extending parallel to the first face.

In some implementations, the panel comprises a third opening extending through and nonparallel to the first face and the second face, and a fourth opening extending through and nonparallel to the first face and the second face. In such implementations, the attachment system may further comprise a second flexible length of strands extending through the third opening and through the fourth opening. Referring to FIGS. 29 through 32, the second flexible length of strands may comprise a fourth portion comprising bundled strands along the first face and extending parallel to the first portion the flexible length of strands, a fifth portion comprising splayed strands, extending from the third portion and extending along the second face; and a sixth portion comprising splayed strands, extending from of the fourth portion on a side of the fourth portion opposite the fifth portion, the splayed strands of the sixth portion interleaved amongst the splayed strands of the third portion, wherein the bonding layer is laminated to the second face over interleaved strands of the sixth portion and the third portion.

Figure 33:
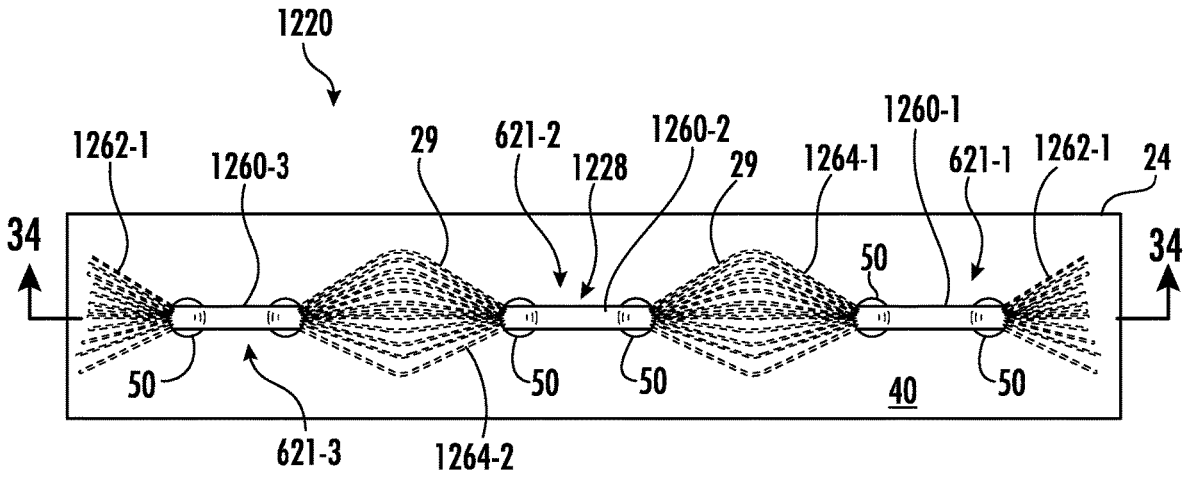
FIG. 33 is a top view of portions of an example attachment system.
Figure 34:
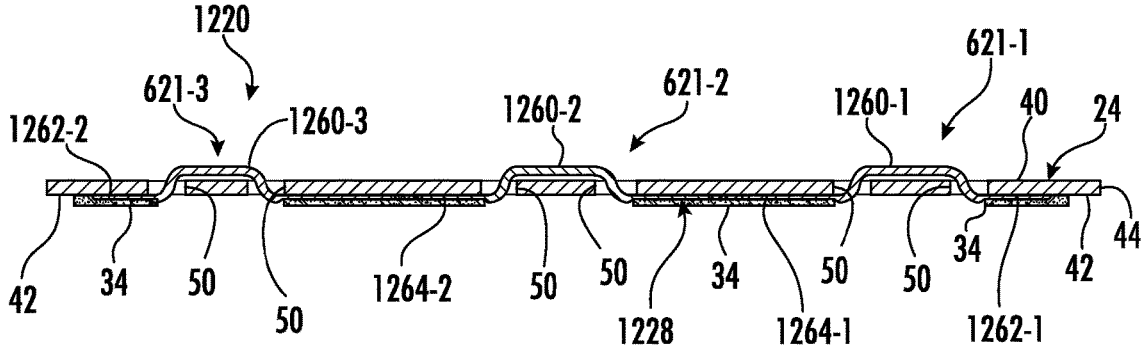
FIG. 34 is a sectional view of the attachment system of FIG. 33 taken along line 34-34.

Referring to FIGS. 33 and 34, in some implementations, the panel may comprise a third opening extending through and nonparallel to the first face and the second face and a fourth opening extending through and nonparallel to the first face and the second face. The flexible length of strands may extend through the third opening and the fourth opening and may further comprise a fourth portion extending from the third portion, comprising bundled strands, and extending along the first face of the panel, and a fifth portion extending from the fourth portion, comprising splayed strands and extending along the second face of the panel. In such implementations, the attachment system may further comprise a second bonding layer laminated to the second face of the panel with the splayed strands of the fifth portion sandwiched between the second bonding layer and the second face.

Figure 2:
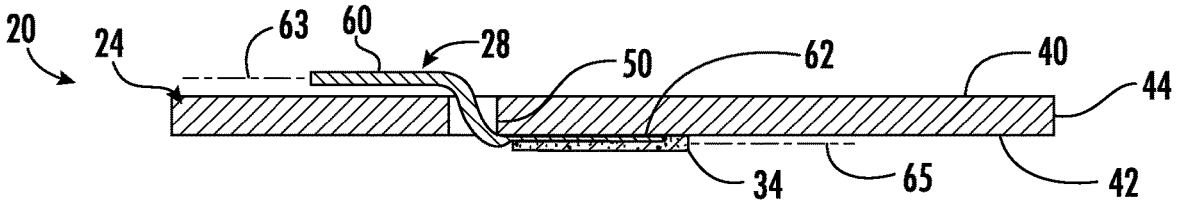
FIG. 2 is a sectional view of the attachment system of FIG. 1 taken along line 2-2.
Figure 3:
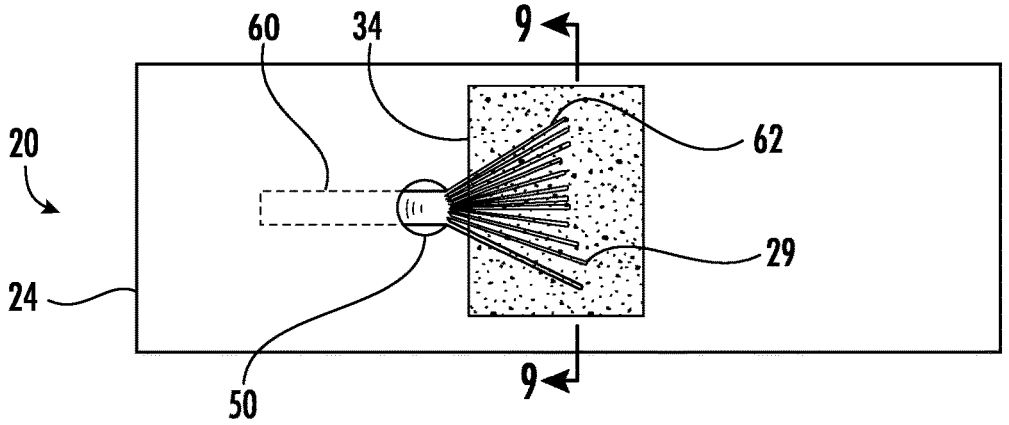
FIG. 3 is a bottom view of portions of the example attachment system of FIG. 1.

FIGS. 1-3 illustrate portions of an example attachment system 20. System 20 utilizes a flexible length of strands having a first portion of bundled strands on a first side of a panel for connection to an attachment or accessory and a second portion of splayed strands bonded to a second side of the panel. Attachment system 20 may be less complex and less costly as compared to existing attachment systems. Attachment system 20 offers a strong attachment mechanism with a flatter profile. Attachment system 20 comprises panel 24, a flexible length of strands 29 and a bonding layer 34.

Panel 24 comprise a sheet of a material or multiple materials forming a portion of an article, such as a garment or pack. Examples of a garment include, but are not limited to, a jacket, vest, pants or any other piece of apparel that may be worn by a person. Examples of a pack include, are not limited to, a backpack, a pouch, or any other container that may be carried or supported by a person. In some implementations, panel 24 may be part of other articles or other structures, such as tents, furniture and the like.

Panel 24 has a first face 40, a second face 42 and edge 44 between the first face and the second face. Panel 24 further comprises an opening 50 extending through and nonparallel to the first face 40 and the second face 42. As should be appreciated, panel 24 is not necessarily rectangular. For purposes of illustration, only that portion of a larger panel 24 containing opening 50 is shown. In some implementations, panel 24 is flexible. In some implementations, panel 24 is inflexible.

In some implementations, panel 24 comprises a single layer of homogenous material. In some implementations, panel 24 comprises a single layer of multiple dissimilar materials. In some implementations, panel 24 may comprise multiple overlapping layers of dissimilar materials. Such different overlapping layers may be laminated to one another or may be joined to one another only along their edges or only along selected overlapping portions. In some implementations, selected portions of panel 24 may include multiple layers of material or layers of different material. For example, those portions of panel 24 about opening 50 (or between consecutive openings and panel 24) may be provided with an additional layer or multiple additional layers of material on face 40 and/or face 42 to provide additional tear resistant or wear resistant strength. In some implementations, panel 24 may comprise multiple layers of material, wherein the layer of material adjacent to face 42 was in a prior liquid or fluid state when being bonded to the flexible length of strands 29, and wherein the layer, upon curing or otherwise solidifying, assists in bonding portions of the flexible length of strands to the face 42. In some implementations, panel 24 may comprise a coated or uncoated fabric material. In some implementations, panel 24 may comprise a polymeric material, such as vinyl. In yet other implementations, panel 24 may be formed from other materials.

Faces 40 and 42 comprise those portions of panel 24 having the major surface areas of panel 24, forming the length and width of panel 24. Edge 44 extends between faces 40 and 42 along the thickness of panel 24. Opening 50 facilitates the passing of the flexible length of strands 29 through panel 24. Although opening 50 is illustrated as being circular, in other implementations, opening 50 may have other shapes. In some implementations, opening 50 may comprise a slit or a slice (no material of panel 24 being removed to form opening 50) through panel 24.

The flexible length of strands 29 comprises an amalgamation of multiple individual strands 29 of material, wherein the individual strands 29 of material may be of the same material or may comprise strands of dissimilar materials. Individual strands 29 of the flexible length may have different compositions, cross-sectional shapes and/or dimensions. For example, in some implementations, the individual strands 29 may comprise a central core strand or multiple central core strands, each of the core strands having a first diameter, wherein a multitude of other strands 29 having smaller diameters are wound, wrapped or braided about the central core strand(s). In some implementations, such individual strands 29 may be formed from natural, organic materials derived from plants or animals. In some implementations, such individual strands 29 may be formed from polymers. The flexible length of strands may be elastic or inelastic. In some implementations, the flexible length 28 of strands may be in the form of a strap, a cord or a rope. In some implementations, the amalgamation of multiple individual strands 29 forming the flexible length of strands 29 may have a circular cross-section, and oval cross-section, or a rectangular cross-section.

Figure 6:
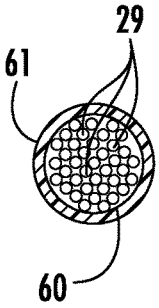
FIG. 6 is a cross-sectional view of wrapped bundled strands.
Figure 4:
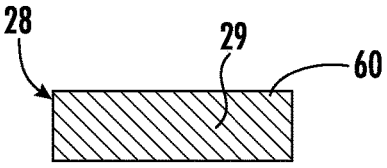
FIG. 4 is a side view of a portion of wound bundled strands.
Figure 7:
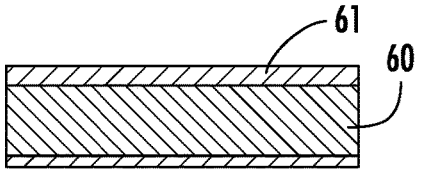
FIG. 7 is a sectional view of wound and wrapped bundled strands.
Figure 5:
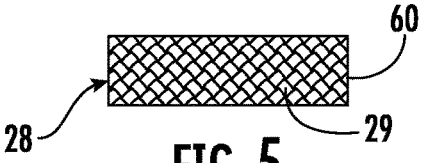
FIG. 5 is side view of braided or woven bundled strands.
Figure 8:
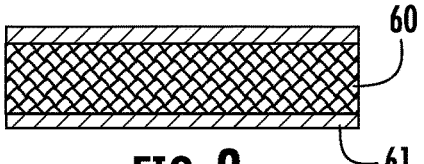
FIG. 8 is a sectional view of woven or braided and wrapped bundled strands.

The individual strands 29 have different configurations along their lengths. The individual strands 29 are bundled along a first portion of their lengths to form a first portion 60 of length 28 and are splayed (fanned) along a second portion of their lengths to form a second portion 62 of length 28. Stated another way, each individual strand of the length 28 comprises a portion that is bundled relative to other strands of the length 28 and comprise a portion that is splayed or spread apart from other strands of the length 28. The bundling of the individual strands 29 may be by winding/twisting the individual strands 29 about a central axis as shown by FIG. 4. The bundling of the individual strands 29 may be by weaving or braiding the individual strands 29 as shown by FIG. 5. In some implementations, the winding or braiding of strands may be supplemented with an adhesive coating or impregnation. The bundling of the individual strands may be by wrapping the individual strands 29 with an outer covering as shown in FIG. 6. In some implementations, the bundling of the individual strands may be with an adhesive or other material that bonds the individual stands to one another. In some implementations, the bundling of the individual strands may be by fusing the exterior surfaces of such strands to one another. For example, the exterior surfaces of such strands may be formed from a thermoplastic material, permitting the exterior surfaces to be melted and fused to one another. In some implementations, the exterior surfaces may be formed from a thermoset material, wherein the strands are fused to one another during or prior to curing of the thermoset material. In some implementations, the wound strands 29 may be additionally wrapped as shown in FIG. 7. In some implementations, the woven or braided strands 29 may be additionally wrapped as shown in FIG. 8.

As shown by FIG. 6, in some implementations, the bundled portions of the strands 29 forming the first portion 60 may be wrapped by being housed, encased, coated or otherwise covered by an outer covering 61 in the form of a coating or outer sheath. FIG. 7 illustrates an example implementation where the bundled portions of strands are wound and wherein the amalgamation of strands is covered by an outer covering 61. FIG. 8 illustrates an example implementation where the bundled portions of the strands are braided or woven and wherein the amalgamation of strands is covered by an outer covering 61.

In some implementations, the individual strands of the splayed strands comprise individual or distinct sub-bundles of strands or fibers. For example, each of the individual strands that are splayed may still be part of sub-bundles of stands/fibers that remain woven, braided, bonded, fused, and/or wrapped/sheathed to one another. In contrast, the bundled portion of the flexible length of strands comprises a bundling of the sub-bundles, wherein the sub-bundles of strands, themselves, are further woven, braided, bonded, fused, and/or wrapped/sheathed to one another. One example of such a bundling of sub-bundles is a kernmantle rope. In some implementations, the individual strands of the sub-bundles may themselves be further splayed.

The splayed portions of strands 29 forming the second portion 62 of the flexible length 28 are unwoven, unbraided, unwound or unwrapped and spread apart from one another to fan out from the first portion 60 along the second face 42 of panel 24. The splayed portions of the strands 29 forming portion 62 are bonded, directly or indirectly, to the second face 42. The splayed portions of the strands 29 forming portion 62 extend opposite to and across a larger surface area of the panel 24 as compared to a width of the bundled portions of the strands 29 forming portion 60. This larger surface area provides a stronger connection to the panel 24 and offers a flatter profile across the face 42 of the panel 24. In some implementations, the first bundled portion 60 of the flexible length of strands 29 has a maximum width W1 lying in a first plane 63, on a first side of the panel 24, parallel to the first face 40 the panel 24 (diameter of a cylinder or transverse width of a flat band), wherein the second portions of splayed strands 29 forming portion 62 and extending from the first bundled portion 60 have a second maximum width W2 lying in a second plane 65, on a second side of the panel 24, parallel to the first plane 63, that is greater than the first maximum width W1. The second maximum width W2 is defined as the largest with of the fan of splayed strands, the spacing between two of the splayed strands that are spread apart from one another by the largest distance. In some implementations, the second maximum width W2 is at least five times the first maximum width W1. In some implementations, the second maximum width W2 is at least 20 times the first maximum width W1.

Figure 9:
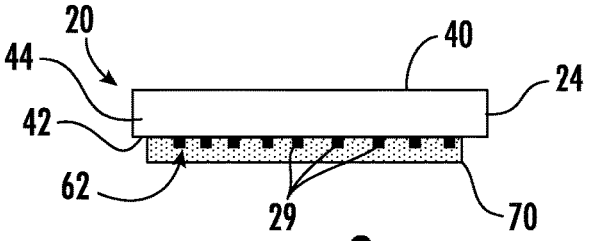
FIG. 9 is a sectional view of the attachment system of FIG. 3 taken along line 9-9.

The splayed portions of strands 29 forming portion 62 of the flexible length 28 may be bonded, directly or indirectly, to the second face 42 of the panel 24 in various different fashions. In the example illustrated in FIGS. 1-3, the splayed portion strands 29 are bonded to the second face 42 with bonding layer 34. In the example shown in FIG. 9, the bonding layer 34 comprises a film or layer of adhesive 70 that is coated, adhered to or otherwise applied to the second face 42 of the panel 24, wherein the splayed strands 29 are placed in contact with the layer of adhesive 70. In some implementations, the bonding layer 34 may comprise a liquid or fluid adhesive that is applied to the second face 42 of the panel 24, wherein the fluid adhesive encapsulates the splayed strands 29 prior to solidifying or curing.

Figure 10:
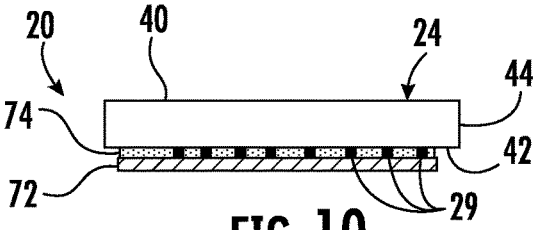
FIG. 10 is a sectional view of another implementation of the attachment system of FIG. 3 taken along line 9-9.

In the example shown in FIG. 10, the bonding layer 34 may comprise a film or other layer 72 having an adhesive layer 74 so as to form a one-sided tape that is bonded or adhered to the second face 42 with the splayed strands 29 being captured are sandwiched between the bonding layer 34 and the second face 42 of the panel 24.

Figure 11:
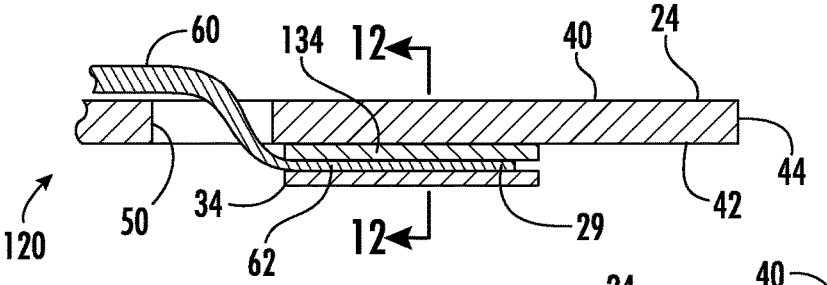
FIG. 11 is a sectional view illustrating portions of an example attachment system.
Figure 12:
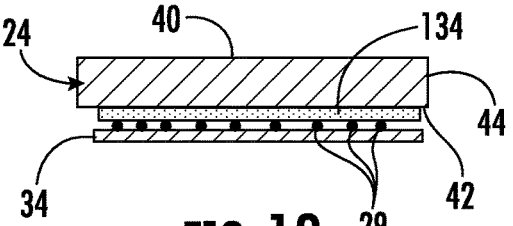
FIG. 12 is a sectional view of the attachment system of FIG. 11 taken along line 12-12.

FIGS. 11 and 12 illustrates portions of an example attachment system 120. FIGS. 11 and 12 illustrate an example of how the splayed portions of strands 29 may be adhered to the face 42 of panel 24 using multiple bonding layers. System 120 is similar to system 20 above except that system 120 additionally comprises bonding layer 134. Those remaining components of system 120 which correspond to components of system 20 are numbered similarly.

Bonding layer 134 comprises a layer of material applied to face 42 of panel 24. Bonding layer 134 is deposited or applied to face 42 prior to the positioning of the splayed strands 29. In some implementations, bonding layer 134 comprise an adhesive material. In some implementations bonding layer 134 comprises a layer of fluid or liquid material which has been cured or otherwise solidified to adhere to face 42 and to also adhere to the splayed strands 29. Thereafter, bonding layer 34 (described above) may be formed or applied over the splayed strands 29, the bonding layer 34 bonding to bonding layer 134 and encapsulating or capturing the splayed strands 29 between bonding layers 34 and 134.

Figure 13:
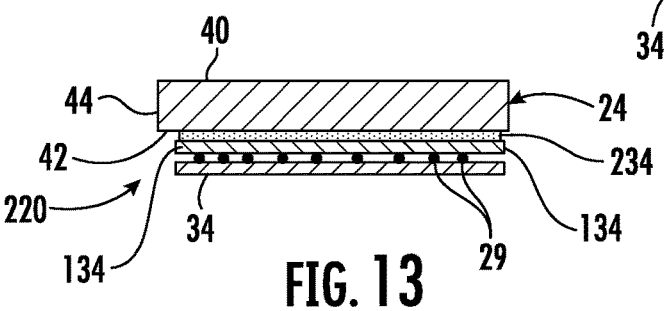
FIG. 13 is a sectional view of another implementation of the attachment system of FIG. 11 taken along line 12-12.

FIG. 13 illustrates portions of an example attachment system 220. FIG. 13 illustrates another example of how the splayed strands 29 may be bonded to panel 24. Attachment system 220 is similar to attachment system 120 described above except that attachment system 220 comprises an additional bonding layer 234. Those remaining components of attachment system 220 which correspond to components of attachment system 120 are numbered similarly and/or are shown and described above with respect to attachment systems 20 and 120.

Bonding layer 234 comprise a layer of material sandwiched between bonding layer 134 and face of panel 24. In some implementations, bonding layer 234 comprises a layer of adhesive. In other implementations, bonding layer 234 comprises a layer of a previous liquid or fluid which has been cured or otherwise solidified so as to be joined to face 42 and bonding layer 134. Similar to bonding layer 34 of system 120, bonding layer 34 of system 220 is bonded to bonding layer 134, capturing the splayed strands 29 which are sandwiched between bonding layers 34 and 134.

Figure 14:
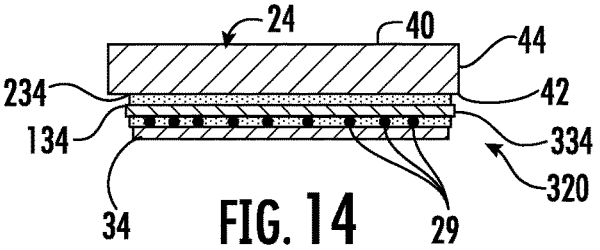
FIG. 14 is a sectional view of another implementation of the attachment system of FIG. 11 taken along line 12-12.

FIG. 14 illustrates portions of an example attachment system 320. FIG. 14 illustrates another example of how the splayed strands 29 may bonded to panel 24. Attachment system 320 is similar to attachment system 220 described above except that attachment system 320 comprises an additional bonding layer 334. Those remaining components of attachment system 320 which correspond to components of attachment system 220 are numbered similarly and/or are shown and described above with respect to Systems 20, 120 and 220.

Bonding layer 334 comprises a layer of a previously liquid or fluid material that encapsulates the splayed strands 29, wherein the liquid or fluid layer is solidified through curing or evaporation to secure the splayed strands 29. Such solidification further results in layer 334 bonding to and between layers 34 and 134. In one implementation, bonding layer 334 comprises a layer of epoxy. In other implementations, bonding layer 334 may comprise other materials which have solidified about splayed strands 29.

Figure 15:
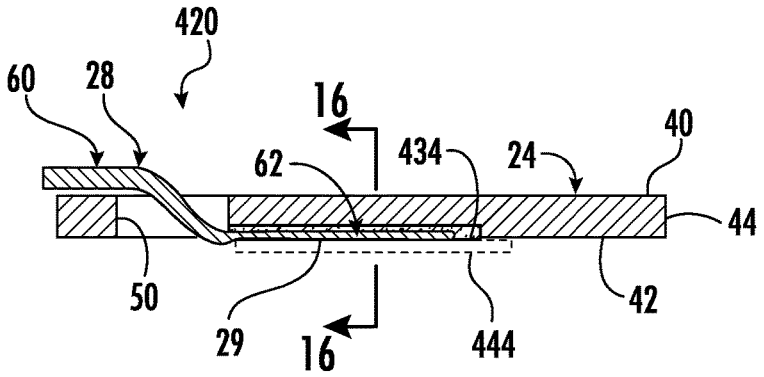
FIG. 15 is a sectional view illustrating portions of an example attachment system.
Figure 16:
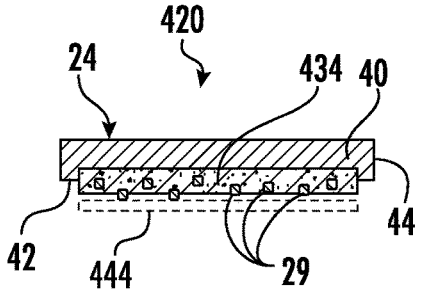
FIG. 16 is a sectional view of the attachment system of FIG. 15 taken along line 16-16.

FIGS. 15 and 16 illustrate portions of an example attachment system 420. FIG. 15 illustrates another example of how the splayed strands 29 may bonded to panel 24. In contrast to the above-described attachment systems 20, 120, 220 and 320 which employ bonding layers to bond the splayed strands 29 to face 42 of panel 24, attachment system 420 bonds the splayed strands 29 to panel 24 by positioning the splayed strands 29 into contact with face 42 while face 42 is in a melted or otherwise liquid state. Upon solidification, the previously acquitted portions of face 42 bond to the splayed strands. Those components of system 420 which correspond to components of systems 20, 120, 220 or 320 are numbered similarly and/or are shown and described above with respect to such systems.

System 420 includes a previously liquid or melted portion 434 (schematically indicated by stippling) which contacts and, upon solidification, adheres to or grips portions of the splayed strands 29. In some implementations, the splayed strands 29 are positioned against portion 434 while portion 434 is in a solid-state, wherein portion 434 is then heated to a molten state, permitting portion 434 fused to or at least partially encapsulate the splayed strands 29. In some implementations, portion 434 is in a molten state prior to the positioning of the splayed strands 29 being positioned in contact with portion 434. As shown by FIG. 16, some of the splayed strands may be completely encapsulated by the molten portion 434 and some of the splayed strands may rest on a surface of the molten portion 434 prior to the solidification of portion 434.

As indicated by broken lines, in some implementations, system 420 may additionally comprise a cover layer 444 which extends over portion 434, sandwiching the splayed strands 29 between the cover layer 444 and portion 434 of panel 24. In some implementations, the cover layer 444 may comprise another layer of molten material which is solidified. In some implementations, cover layer 444 may comprise a layer which is positioned against portion 434 over splayed strands 29 while portion 434 is molten, fusing layer 444. In yet other implementations, cover layer 444 may be bonded to portion 434, over splayed strands 29, after portion 434 has solidified. For example, cover layer 444 may comprise a film with an adhesive. Cover layer 444 provides a smooth even surface for covering and protecting any potentially exposed splayed strands 29.

Figure 17:
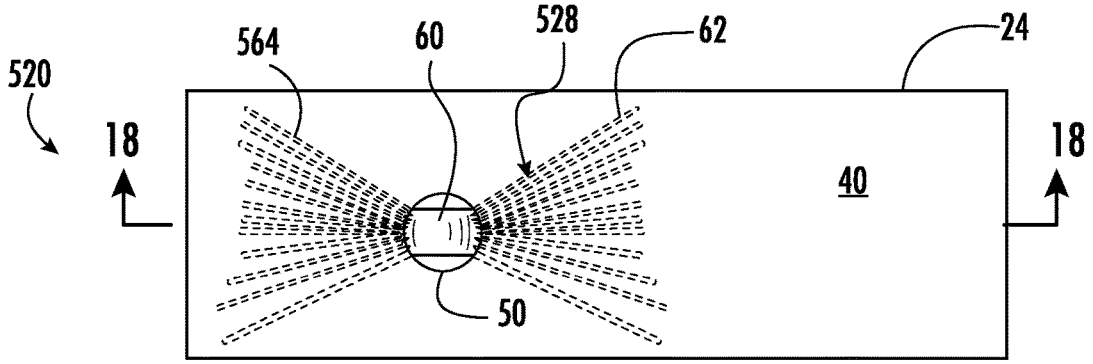
FIG. 17 is a top view of portions of an example attachment system.
Figure 18:
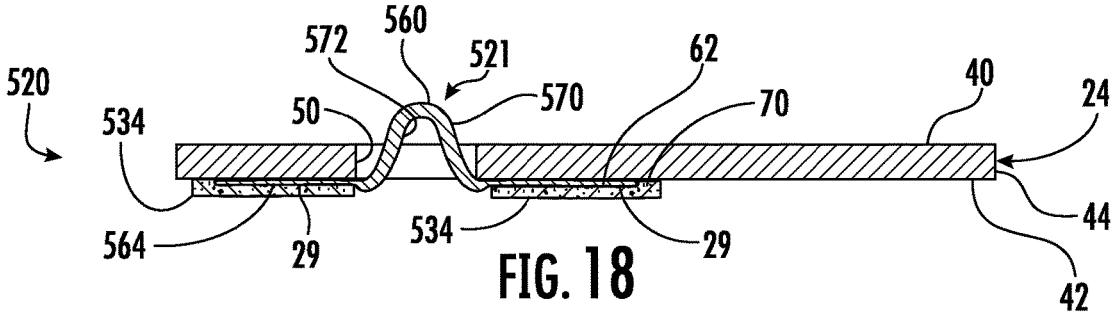
FIG. 18 is a sectional view of the attachment system of FIG. 17 taken along line 18-18.
Figure 19:
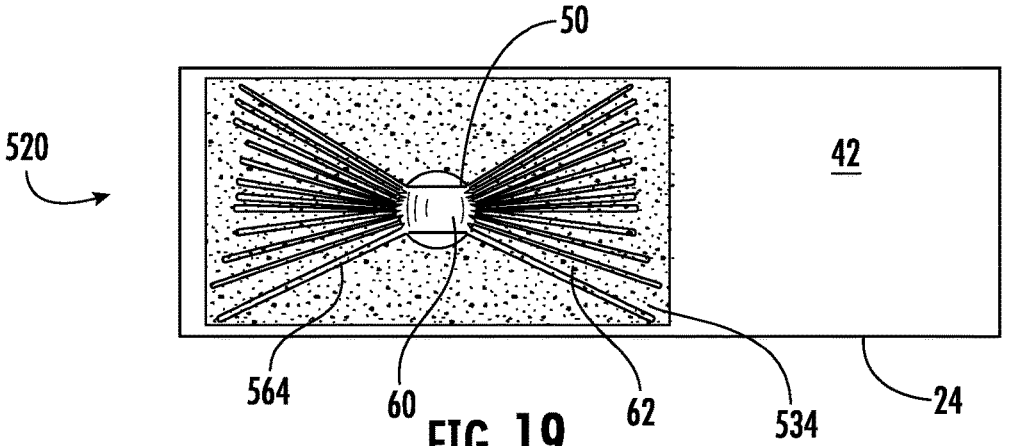
FIG. 19 is a bottom view of portions of the example attachment system of FIG. 17.

FIG. 17-19 illustrate portions of attachment system 520. FIG. 17-19 illustrate an example of how a pair of splayed strands on opposite sides of a bundled strands may form a loop connector 521 for receiving accessories that are to be mounted to a panel of a garment, pack or other article. Attachment system 520 is similar to attachment system 20 described above except that the strands 29 of the flexible length 28 are splayed or fanned out at both ends on opposite sides of the bundled portions of strands 29 and that both of the splayed strand portions are bonded to the face 42 of the panel 24 to form the loop connector 521. Those portions of system 520 which correspond to portions of system 20 are numbered similarly.

As shown by FIG. 18, system 520 comprises a flexible length 528 of strands 29 that passes through the opening 50 twice, forming a loop 570 projecting from the first face 40 of panel 24. Loop 570 forms an opening 572 extending opposite to opening 50. Flexible length 528 is similar to 20 described above except that flexible length 528 comprises a third portion 564 comprising splayed portions of the strands 29. Third portion 560 extends on an opposite side of the first portion 60 as the second portion 62. The splayed strands of third portion 560 are bonded to face 42 of panel 24. The splayed strands of third portion 560 may be similar to the splayed strands of second portion 562 and may mirror the splayed strands of second portion 62.

As shown by FIGS. 18 and 19, the splayed strands of portion 564 may be directly bonded to face 42 with a bonding layer 534. Bonding layer continues extends along face 42 covering both portion 62 and 564 and bonding the splayed strands of such portion to face 42. In the example illustrated, bonding layer 534 comprises a film or layer of adhesive 70 that is coated, adhered to or otherwise applied to the second face 42 of the panel 24, wherein the splayed strands 29 are placed in contact with the layer of adhesive 70. In some implementations, the bonding layer 34 may comprise a liquid or fluid adhesive that is applied to the second face 42 of the panel 24, wherein the fluid adhesive encapsulates the splayed strands 29 prior to solidifying or curing.

In some implementations, the bonding layer 534 may comprise a film or other layer having an adhesive layer 70 so as to form a one-sided tape that is bonded or adhered to the second face 42 with the splayed strands 29 being captured are sandwiched between the bonding layer 534 and the second face 42 of the panel 24. In other implementations, the splayed strands 29 of both of portion 62 and 564 may be directly or indirectly bonded to face 42 of panel 24 by any of the structures and methods shown and described above with respect to FIGS. 10-16.

Figure 20:
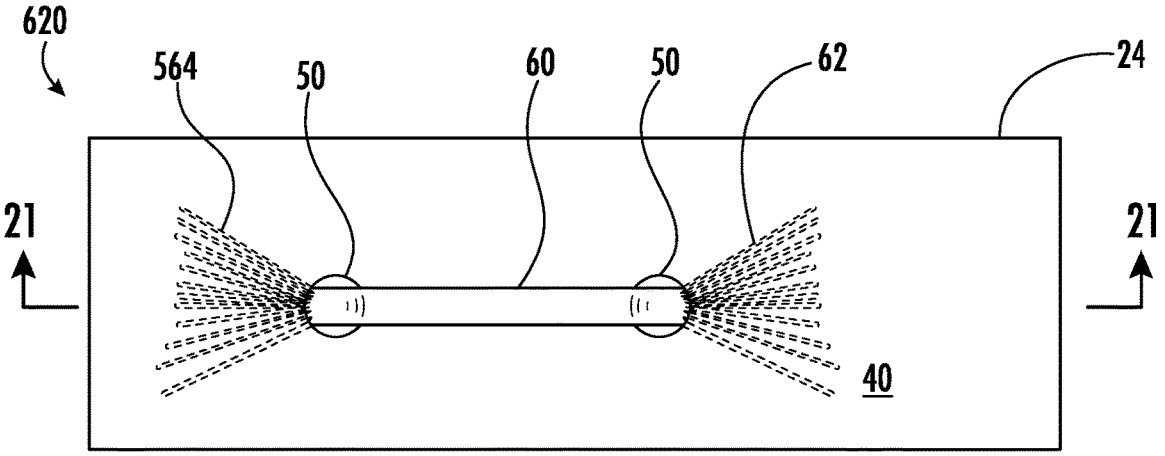
FIG. 20 is a top view of portions of an example attachment system.
Figure 21:
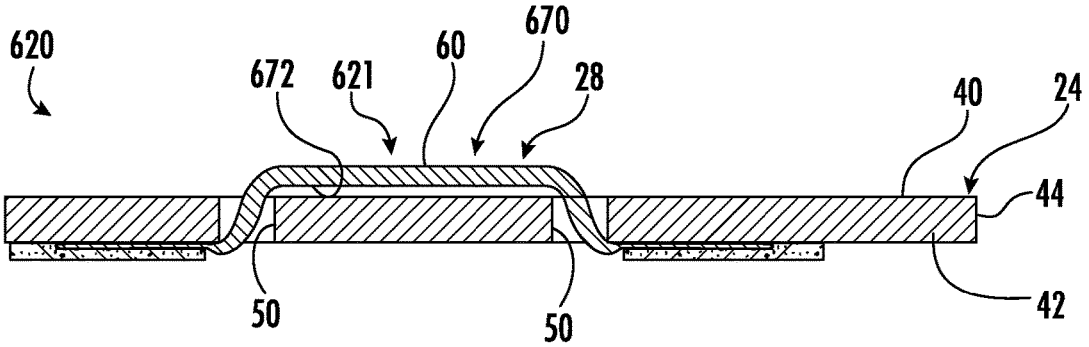
FIG. 21 is a sectional view of the attachment system of FIG. 17 taken along line 21-21.
Figure 22:
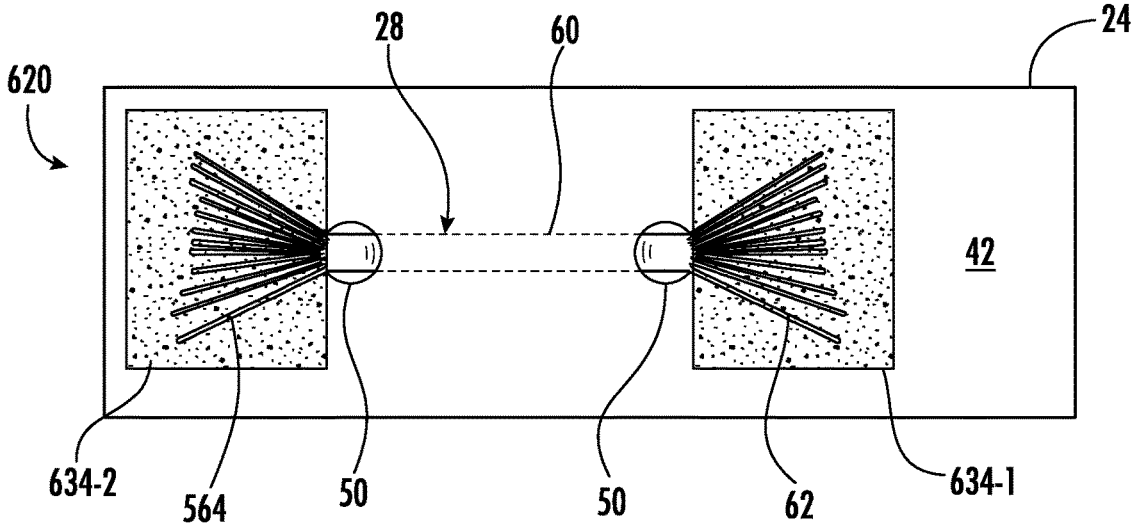
FIG. 22 is a bottom view of portions of the example attachment system of FIG. 20.

FIGS. 20-22 illustrate portions of attachment system 620. FIGS. 20-22 illustrate an example of how the panel may include a pair of openings, wherein the bundled strands of the flexible length extend across the panel between the pair of openings to form loop connector 621 forming a panel backed opening or passage for receiving accessories that are to be mounted to a panel of a garment, pack or other article. Attachment system 620 is similar to attachment system 520 described above except that panel 24 comprises a pair of openings 50 and that the portion 60 of the flexible length 28 comprising the bundled portions of the strands extends through and between each of such openings 50. Those components of attachment system 620 which correspond to components of attachment system 520 are numbered similarly.

In the example illustrated, the portion 62 and 564 of the flexible length 28 including the splayed strands 29 are bonded to face 42 of panel 24 by two separate bonding layers 634-1 and 634-2. Each bonding layer 6 bonding layer 534 described above. In other implementations, single bonding layer 534 may be utilized to bond both of portions 62 and 564 to face 42 of panel 24. In yet other implementations, portion 62 and 564 may be bonded to face 42 using the any of the above-described bonding structures described above with respect to FIGS. 10-16.

As shown by FIG. 21, portion 60 of flexible length 28 comprising strands 29 extends across and overlaps those portions of face 40 lying between openings 50. Portion is not bonded to face 42, forming a loop 670 having an opening or passage 672 extending between face 40 and portion 60. Passage 672 may slidably receive strap, ring or other accessory that is to be mounted to the article including panel 24. In the example illustrated, openings 50 are spaced, center-to-center, by a distance of at least 30 mm. In other implementations, openings 50 may be spaced by other distances.

Figure 23:
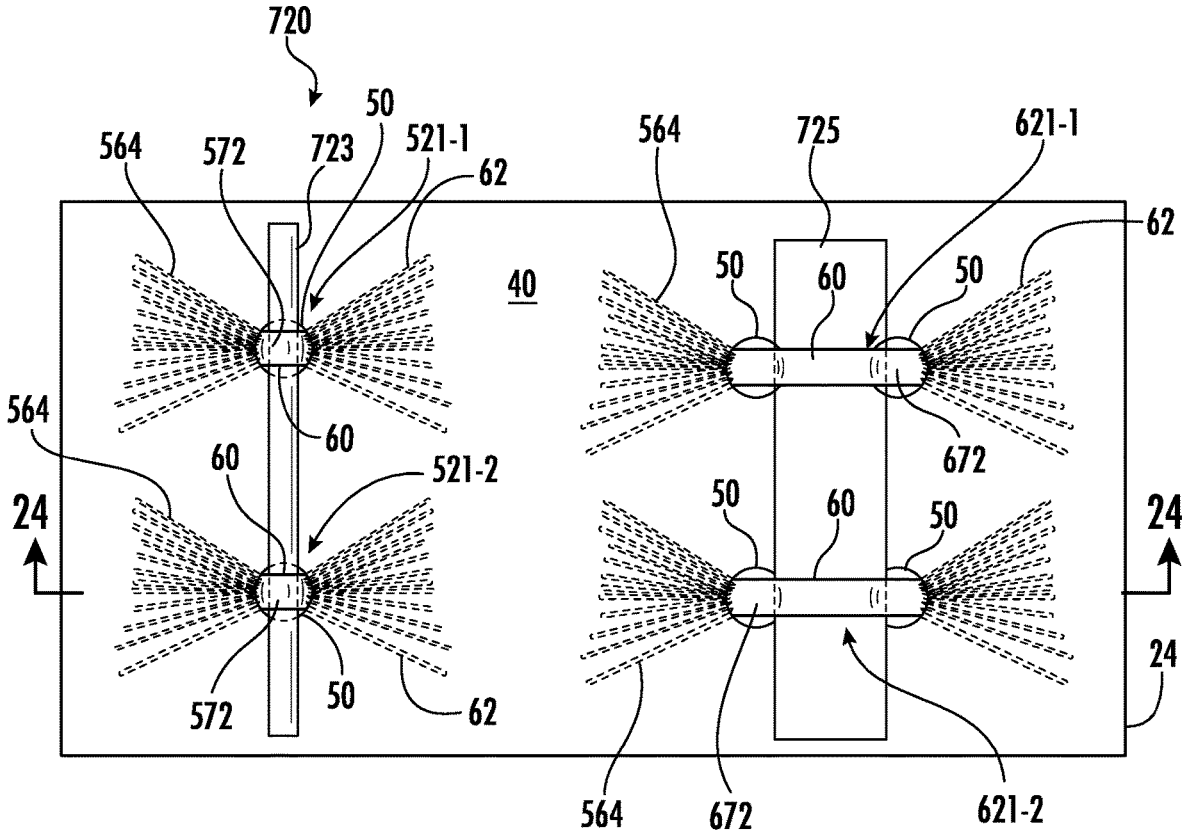
FIG. 23 is a top view of portions of an example attachment system.
Figure 24:
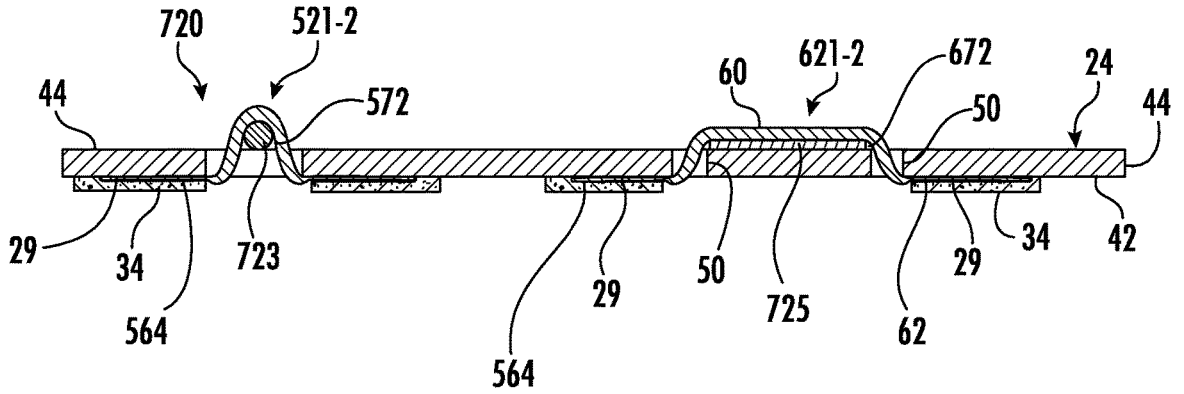
FIG. 24 is a sectional view of the attachment system of FIG. 23 taken along line 24-24.

FIGS. 23 and 24 illustrate portions of an example attachment system 720. FIGS. 23 and 24 illustrate an example of how an attachment system may be used to retain a cord or strap along and adjacent to a panel of a pack, garment or other article. Attachment system 720 comprises panel 24, a first pair of connectors 521-1, 521-2 (collectively referred to as connectors 521) and a second pair of connectors 621-1, 621-2 (collectively referred to as to connectors 621). Connectors 521 are described above to FIG. 17-19. Connectors 621 are described above with respect to FIGS. 20-22.

As shown by FIG. 23, connectors 521 are formed and spaced along panel 24 such that connectors 521 have aligned openings or passages 572. The alignment of passages 572 facilitates sliding and passing of a cord 723 through each of the aligned passages 572. As result, the cord 723 of an accessory may be retained parallel to, against and along face 40 of panel 24. In a similar fashion, connector 621 of formed and spaced along panel 24 such that connector 621 have aligned openings or passages 672. The aligned passages 672 facilitate sliding and passing of a strap 725 through each of the aligned passages 672. As a result, the strap 725, connected to an accessory, may be retained parallel to, against along face 40 of panel 24.

Figure 25:
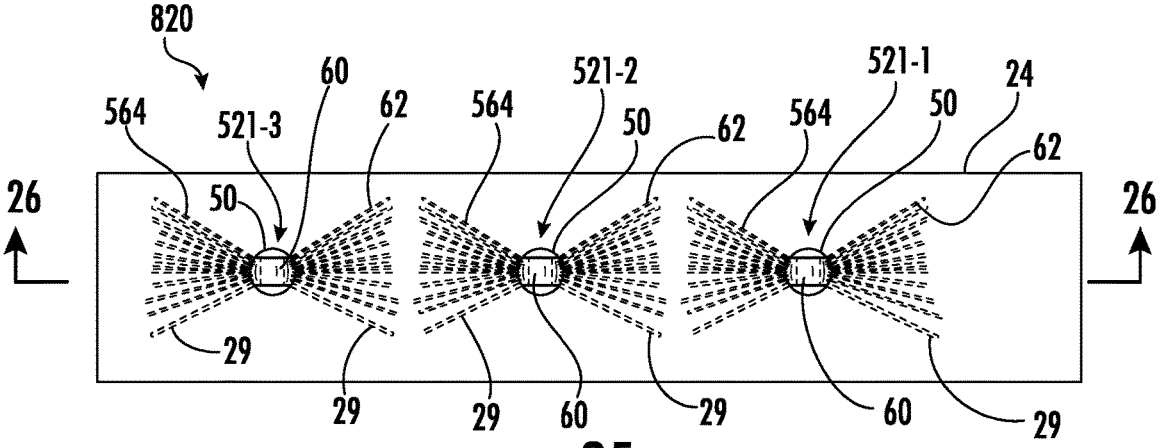
FIG. 25 is a top view of portions of an example attachment system.
Figure 26:
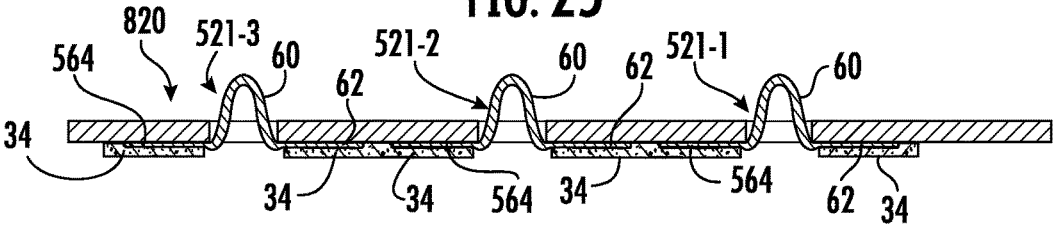
FIG. 26 is a sectional view of the attachment system of FIG. 25 taken along line 25-25.

FIGS. 25 and 26 illustrate portions of an example attachment system 820. FIGS. 25 and 20 illustrate an example of how an attachment system may be used to form a series of connectors along a panel to provide a plurality of selectable mounting points along a garment, pack or other article. Attachment system 820 comprises panel 24 and a series of aligned loop connectors 621-1, 621-2 and 621-3 (collectively referred to as connectors 621). Connectors 621 are described above to FIGS. 17-19.

As shown by FIG. 23, connectors 521 are formed and spaced along panel 24 such that the bundled portions of splines forming portions 60 of the flexible lengths are aligned in a row and such that connectors 521 have openings or passages 572 that are parallel to one another. As result, connectors 521 form a row of connectors offering a multitude of different incrementally spaced mounting locations along panel 24. Such mounting locations may be beneficial along opposite sides of an opening to be closed such as in a garment or pack.

Figure 27:
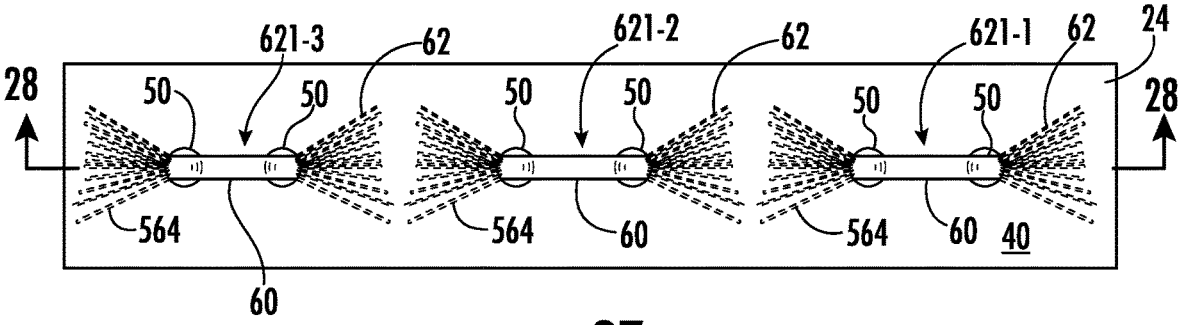
FIG. 27 is a top view of portions of an example attachment system.
Figure 28:
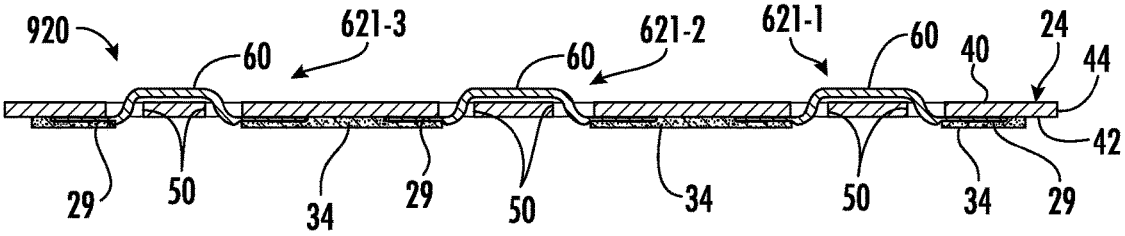
FIG. 28 is a sectional view of the attachment system of FIG. 27 taken along line 28-28.

FIGS. 27 and 28 illustrate portions of an example attachment system 920. FIGS. 27 and 28 illustrated example how the wider panel backed connectors 621 may be arranged in a row provide a series of incrementally spaced mounting locations for a pack or garment. Attachment system 920 is similar to attachment system 820 described above except that the previously described connectors 521 are replaced with connectors 621-1, 621-2 and 621-3. As with connectors 521, connectors 621 are formed and spaced along panel 24 such that the bundled portions of strands forming portions 60 of the flexible lengths are aligned in a row and such that connectors 621 have openings or passages 672 that are parallel to one another. As result, connectors 621 form a row of connectors offering a multitude of different incrementally spaced mounting locations along panel 24. Such mounting locations may be beneficial along opposite sides of an opening to be closed such as in a garment or pack.

Figure 29:
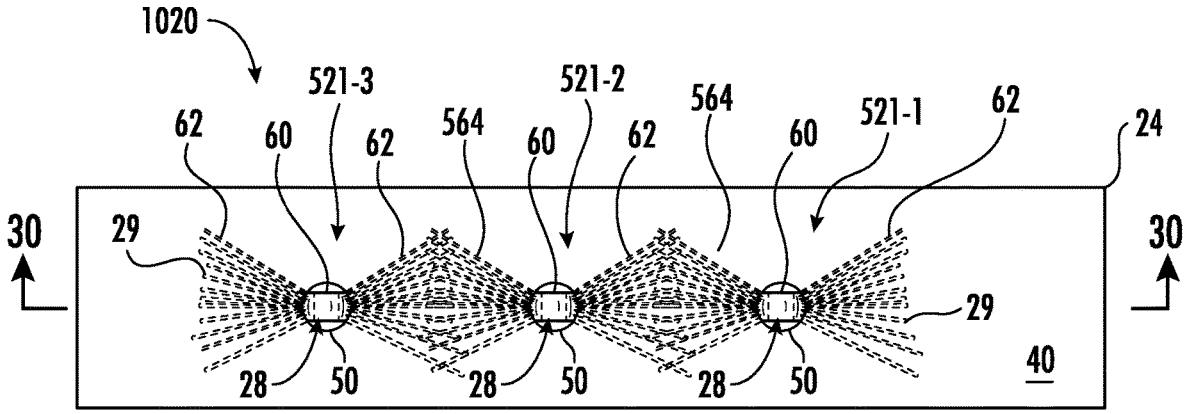
FIG. 29 is a top view of portions of an example attachment system.
Figure 30:
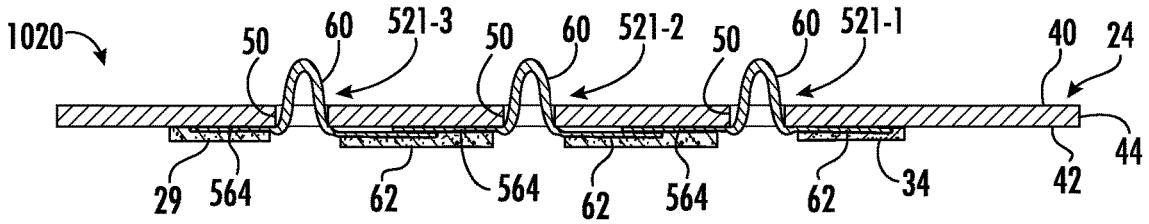
FIG. 30 is a sectional view of the attachment system of FIG. 29 taken along line 30-30.

FIGS. 29 and 30 illustrate portions of an example attachment system 1020. FIGS. 29 and 30 illustrate an example of how the splayed strands of different loop connectors 521 may be interleaved or overlapped to or compactly arrange the loop connectors in a row without sacrificing the strength of the individual loop connectors. Attachment system 1020 is similar to attachment system 820 described above except that the portions of the strands that are splayed and that form portions 62 and 564 of connector 521-2 overlap and/or are interleaved with the individual splayed strands of portion 564 of connector 521-1 and overlap and/or are interleaved with the individual splayed strands of portion 62 of connector 521-3, respectively. As a result, connectors 521 are more compactly arranged. At the same time, the overall surface area of panel 24 covered by the splayed strands and providing connectors 521 with their strength (their resistance to being peeled or torn away from panel 24) is maintained.

Figure 31:
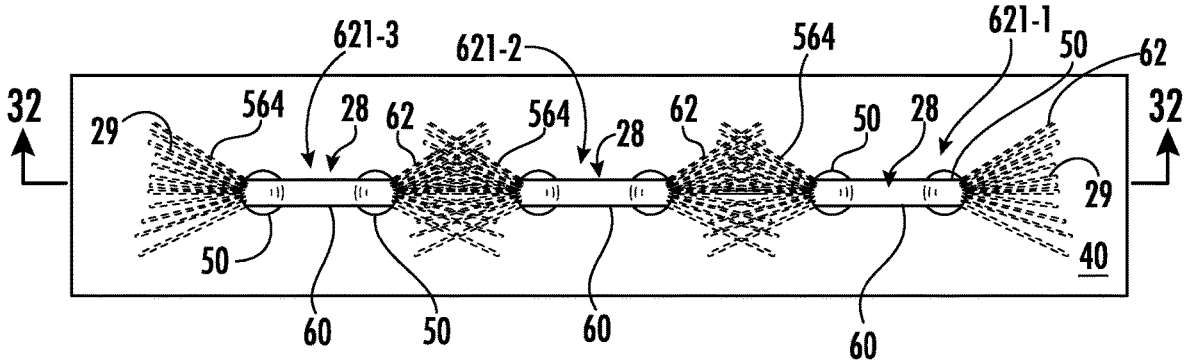
FIG. 31 is a top view of portions of an example attachment system.
Figure 32:
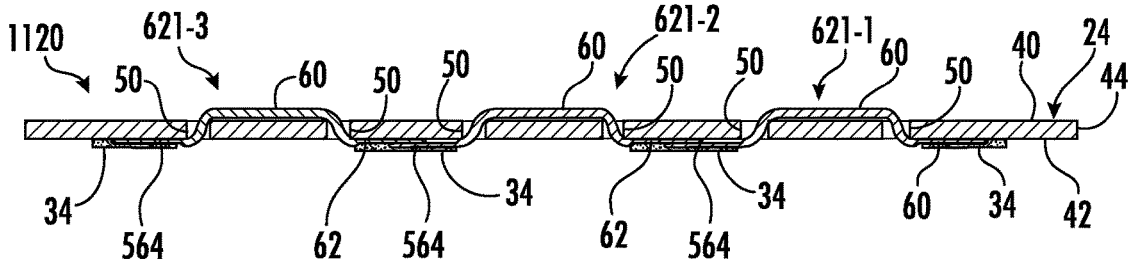
FIG. 32 is a sectional view of the attachment system of FIG. 31 taken along line 32-32.

FIGS. 31 and 32 illustrate portions of an example attachment system 1120. FIGS. 31 and 32 illustrate an example of how the splayed strands of different loop connectors 621 may be interleaved or overlapped to or compactly arrange the loop connectors in a row without sacrificing the strength of the individual loop connectors. Attachment system 1120 is similar to attachment system 920 described above except that the portions of the strands that are splayed and that form portions 62 and 564 of connector 621-2 overlap and/or are interleaved with the individual splayed strands of portion 564 of connector 621-1 and overlap and/or are interleaved with the individual splayed strands of portion 62 of connector 621-3, respectively. As a result, connectors 621 are more compactly arranged. At the same time, the overall surface area of panel 24 covered by the splayed strands and providing connectors 621 with their strength (their resistance to being peeled or torn away from panel 24) is maintained.

FIGS. 33 and 34 illustrate portions of an example attachment system 1220. FIGS. 33 and 34 illustrate an example of how a single continuous flexible length of strands may be alternately splayed and bundled to provide multiple loop connectors on a panel of a garment, pack or other article. Attachment system 1220 is similar to attachment system 920 described above except that loop connectors 621-1, 621-2 and 621-3 are formed from a single continuous length 1228 of alternately splayed and bundled strand portions. Each individual strand of length 1228 forms multiple connectors 621-1, 61-2 and 621-3. Those remaining components of attachment system 1220 which correspond to components of attachment system 920 are numbered similarly and/or are shown and described with respect to the other above-described attachment systems.

As shown by FIG. 33, the single continuous flexible length 1228 of strands comprises portions 1260-1, 1260-2 and 1260-3 (collectively referred to as portions 1260) which comprise bundled portions of strands of the flexible length 1228. The flexible length 1228 further comprises portions 1262-1, 1262-2 and portions 1264-1, 1264-3 (collectively referred to as portions 1264) which comprise splayed portions of the strands of the flexible length 1228. Portions 1260 extend along face 40 of panel 24 and form the loops of loop connectors 621-1, 621-2 and 621-3. Each of portions 1260 may be similar to portions 60 as described above, comprising portions of the strands that are bundled, such as being woven, braided, wound or wrapped.

Portions 1262-1 and 1262-2 are similar to portion 62 of flexible lengths 28 described above. Each of such portions 1262 comprises portions of strands that are splayed or fanned outward and bonded to face 42 of panel 24 by a bonding layer 34. In some implementations, such portions 1262 may be bonded to face 42 of panel 24 in other fashions as described above with respect to FIGS. 10-16 which illustrate alternatives for the bonding of portion 62 to face 42.

Portions 1264 each comprise a portion of the overall length of the strands forming flexible length 1228 that are splayed between bundled portions of the strands forming flexible length 1228. Portion 1264-1 comprises strands that are splayed outwardly (away from the central axis along which flexible length 1228 extends) away from portion 1260-1. The strands of portion 1264-1 then converge or come together once again as they approach portion 1260-2. Likewise, portion 1264-2 comprises strands of splayed outwardly away from portion 1260-2. The strands of portion 1264-2 then converge or come together once again as they approach portion 1260-3. As with portions 62 and 564 of attachment system 620, the splayed portions of strands 29 forming the portions 1264-1 and 1264-2 of the flexible length 1228 are bonded to face 42 of panel 24 by bonding layer 34. The strands forming portions 1264-1 and 1264-2 of the flexible length 1228 are not broken, severed or interrupted, but continually extend between the bundled portions of the same strands. As result, connectors 621 of system 1220 may offer additional strength.

Although portions 1264 are illustrated as being bonded to face 42 of panel 24 by bonding layer 34, in other implementations, portion 1264 may be bonded to face 42 in other fashions. For example, portions 1264 may be bonded to face 42 using any of the bonding structures shown and described above with respect to FIGS. 10-16.

FIGS. 35 and 36 illustrate portions of an example attachment system 1320. FIGS. 35 and 36 illustrate an example of how to separate panels supporting the respective sets of loop connectors 621 of system 920 (shown in FIGS. 27 and 28) may be releasably joined to one another. FIG. 35 illustrates panels 24-1 and 24-2 overlaid upon one another. Panel 24-1 is part of a first garment, pack or other first article and supports loop connectors 621-1-1, 621-1-2, 621-1-3, 621-1-4 and 621-1-5 and 621-1-6 (collectively referred to as connector 621-1). Panel 24-2 is part of a second article to be releasably attached to the first article. Panel 24-2 supports loop connectors 621-2-1, 621-2-2, 621-2-3, 621-2-4, 621-2-5, and 621-2-6 (collectively referred to as connector 621-2). Each of connector 621-162-2 is similar to the connector 621 described above with respect to FIGS. 21 and 22. As shown by FIG. 36, panels 24-1 and 24-2 are overlaid upon one another such that the loop connectors of the two different panels are interleaved amongst one another. In particular, connectors 621-2-1, 621-2-2 and 621-2-3 are located between the row of connector 621-1-1, 621-1-2, 621-1-3 in the row of connectors 621-1-4, 621-1-5 and 621-1-6. Likewise, connectors 621-1-4, 621-1-5 and 621-

1-6 are located between the row of connector 621-2-1, 621-2-2, 621-2-3 and the row of connectors 621-2-4, 621-2-5 and 621-2-6. The openings are passages of each of the connectors are aligned with one another such that weaving straps 1325-1, 1325-2 and 1325-3 may be slid through each of such openings of the respective connectors 621. As shown by FIG. 35, strap 1325-1 passes through the openings of connectors 621-1-1, 61-2-1, 621-1-4 and 61-2-4. Strap 1325-2 passes through connectors 621-1-2, 621-2-2, 621-1-5 and 621-2-5. Lastly, strap 1325-3 passes through connectors 621-1-3, 621-2-3, 621-1-6 and 621-2-6.

Although attachment system 1320 is illustrated as including three straps 1325, in some implementations, strap 1325-2 may be omitted. Although attachment system 1320 is illustrated as utilizing four alternating rows of connector 621, each row including three individual connectors 621, in other implementations, attachment system 1320 may utilize a different number of rows and/or a different number of individual connectors in each row. In some implementations, the individual connectors 621 may have other configurations such as the configuration of connectors 521 described above. Each of such connectors 521 or 621 may likewise have its splayed strands the bonded to the respective panels 24 by any of the bonding techniques or structures shown and described above with respect to FIG. 10-16.

Figure 37:
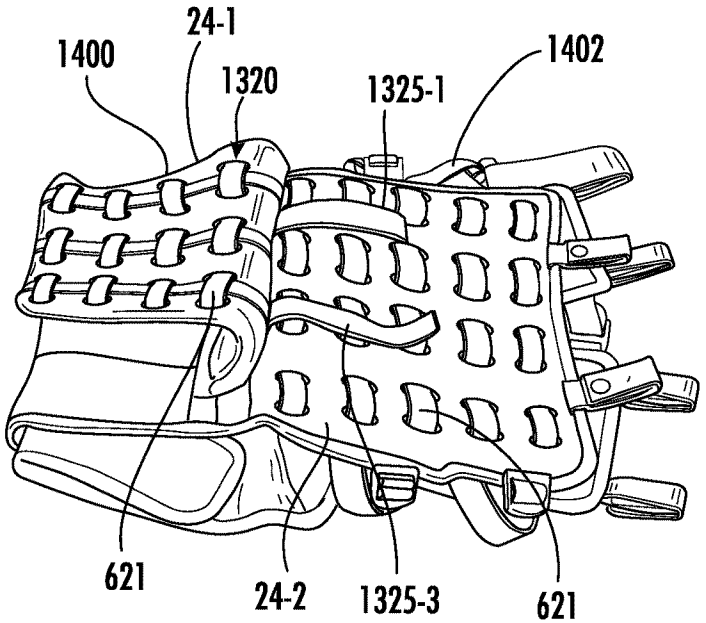
FIG. 37 is a perspective view illustrating the example attachment system of FIGS. 35 and 36 incorporated as part of an example garment in the form of an example vest.

FIG. 37 illustrates an example of attachment system 1320 used to secure a pouch accessory 1400 to a garment 1402 in the form of a tactical, hunting or fishing vest. Garment 1402 is configured to be worn by a person and permits the article, in the form of pouch 1400, to be releasably secured to garment 1402. In the example illustrated, panel 24-1 of attachment system 1320 is incorporated as part of pouch 1400. Panel 24-2 of attachment system 1320 is incorporated as part of garment 1402. In the example illustrated, attachment system 1320 omits strap 1325-2 but weaves straps 1325-1 and 1325-3 through the connectors 621 of pouch 1400 and garment 1402 to secure pouch 1400 to garment 1402. As shown in FIG. 37, attachment system 1320 comprises more than four rows of loop connectors 621 and such rows each comprise more than three loop connector 621. The large number of loop connectors provide a multitude of different mounting locations for securing pouch 1400 to garment 1402. In some implementations, 1325 may have one and affixed to one of pouch 1400 or garment 1402. In some implementations, straps 1325 and portions of the pouch 1400 or garment 1402 may include snaps for securing the ends of straps 1325 once they have been passed through the loop connectors 621.

Figure 38:
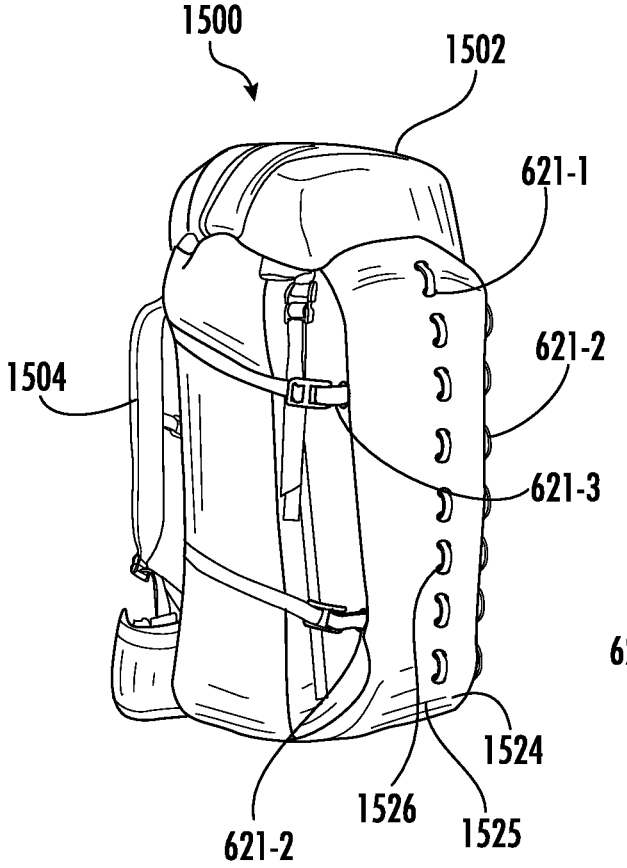
FIG. 38 is a perspective view of an example pack, in the form of an example backpack, including an example attachment system.

FIG. 38 illustrates an example pack 1500, in the form of a backpack, including the above-described attachment systems. Pack 1500 comprises a main compartment portion 1502 and a pair shoulder straps 1504. As shown by FIG. 38, pack 1500 comprises a panel 1524 and the loop connectors 621-1, 621-2 and 621-3 arranged at various locations along panel 1524. In the example illustrated, panel 1524 includes a base layer 1525 and a reinforcement layer 1526 secured to base layer 1525 in regions between and adjacent to the openings through which the flexible lengths of strands extend.

Loop connectors 621-1 comprise a series of individual connectors that vertically extend along pack 1500 vertically along panel 1524. Connectors 621-1 provide a multitude of vertically spaced mounting points or locations along the back of pack 1500. Loop connector 621-2 comprises series of individual connectors and sending along transverse edges of panel 1524. Loop connector 621-2 provide a plurality of possible locations for the connection of compression straps extending from the front of pack 1500 to compress the contents within the main compartment 1502. As should be appreciated, each of connectors 621 is similar to the above-described connector 621 but may be replaced with any of the other connectors such as connectors 521. Moreover, the splayed strands of each of the connectors may be bonded to panel 1524 by any of the above-described mechanisms.

Figure 39:
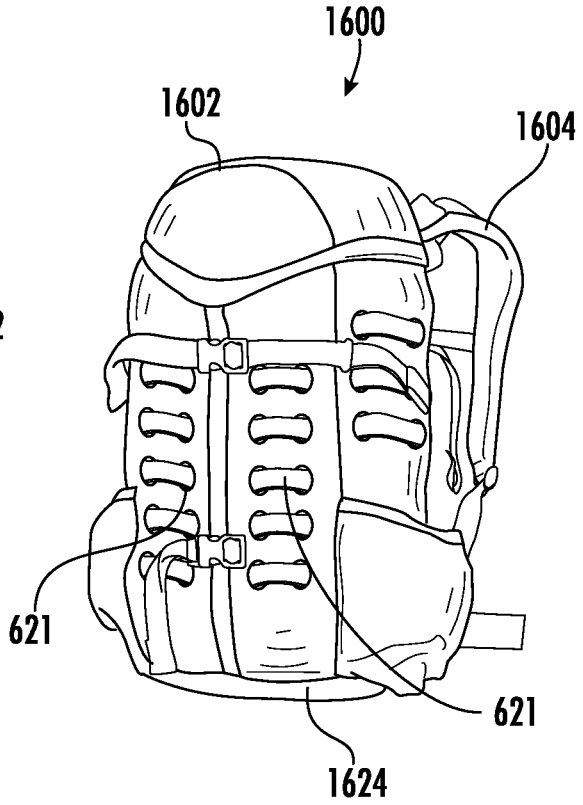
FIG. 39 is a perspective view of an example pack, in the form of an example backpack, including an example attachment system.

FIG. 39 illustrates an example pack 1600 in the form of a backpack. Pack 1600 comprises a main compartment 1602 and shoulder strap 1604. Pack 1600 comprises a panel 1624 supporting connectors 621. Connectors 621 arranged in rows across panel 1624 similar to system 1320 described above. Connectors 621 facilitate the connection of other accessories or articles having similar connectors 621 to facilitate the attachment of articles, such as pouch 1400, two panel 1624 using straps, such as straps 1325.

Figure 40:
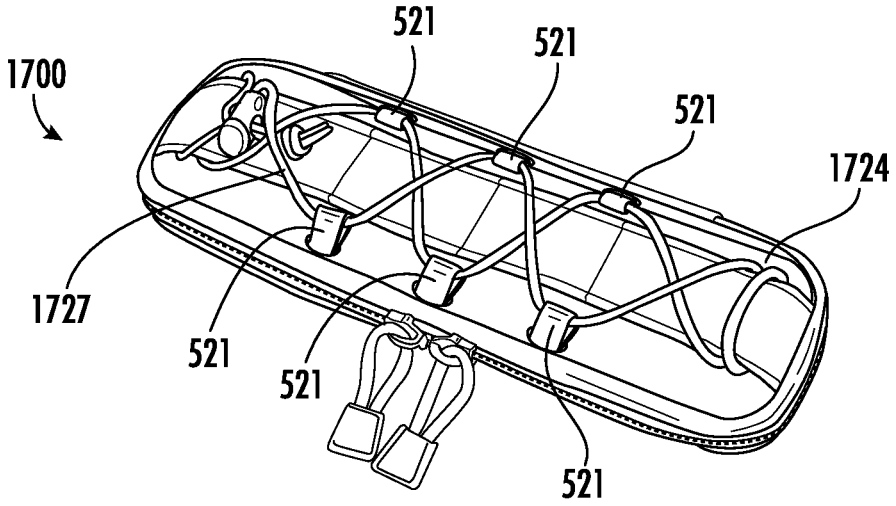
FIG. 40 is a perspective view of an example article, in the form of an example pouch, including an example attachment system.

FIG. 40 illustrates an example article 1700 in the form of a pouch. Article 1700 comprises a pair of spaced columns of connectors 621 supported by panel 1724. Article 1700 further comprises an elastic cord 1727 which passes through each of connectors 521 and alternates between the two columns of connectors 521, providing a crisscross pattern. Elastic cord 1727 may be used to secure additional articles, such as water bottles, jackets or the like, between elastic cord 727 and panel 1724. In some implementations, the opposite side of article 1700 may include connectors 521 of attachment system 1320 for securement to connector 621 of pack 1600 using straps 1325. Again, each of connectors 521 may alternatively comprise connectors 621 described above. Each of connectors 521 (or 621) may have splayed strands that are bonded to panel 1724 by any of the bonding mechanisms described above with spec to FIGS. 10-16.

Figure 41:
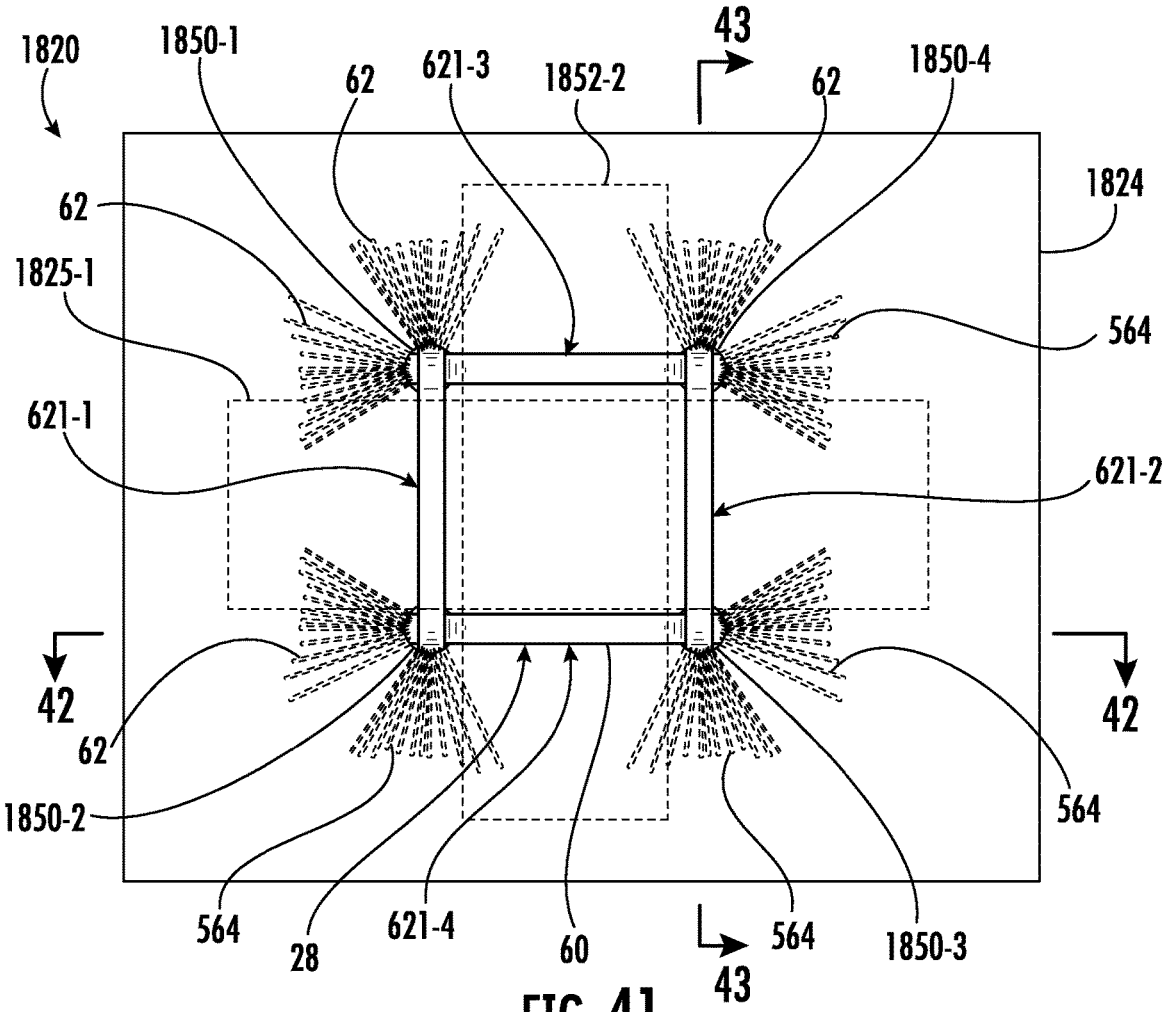
FIG. 41 is a top view illustrating portions of an example attachment system.

FIG. 41 is a top view illustrating portions of an example attachment system 1820. FIG. 41 illustrates an example of how different loop connectors may be arranged orthogonal to one another to form dual axis loops for attaching or other structures along different orthogonal axes. Attachment system 1820 comprises panel 1824, loop connectors 621-1, 621-2, 621-3 and 621-4 (collectively referred to as connectors 621) and bond layer 1834.

Panel 1824 is similar to panel 24 described above except that panel 1824 comprises four openings 1850-1, 1850-2, 1850-3 and 1850-4 (collectively referred to as openings 1850). Panel 1824 has a first face 40, a second face 42 and edge 44 between the first face and the second face. Openings 1850 extend through and nonparallel to the first face 40 and the second face 42. Openings 1850 are similar to openings described above but are angularly spaced 90 degrees from one another (at the corners of an imaginary rectangle or square).

Loop connectors 621 each have a configuration similar to loop connectors 621 described above with respect to FIGS. 27-28 and FIGS. 31-32. Each of loop connectors 621 comprises a flexible length 28 of strands comprising a bundled portion 60 and a pair of opposite splayed portion 62, 564 (described above). In the example illustrated, the bundled portion 60 of loop connectors 621-1 and 621-3 both extend through opening 1850-1. The bundled portions 60 of loop connectors 621-1 and 621-4 both extend through opening 1850-2. The bundled portions 60 of loop connectors 621-2 and 621-4 both extend through opening 1850-3. The bundled portion 60 of loop connectors 621-2 and 621-3 both extend through opening 1850-3. At each of such openings 1850, the bundled portions 60 may overlap one another prior to extending through such openings 1850.

Figure 42:
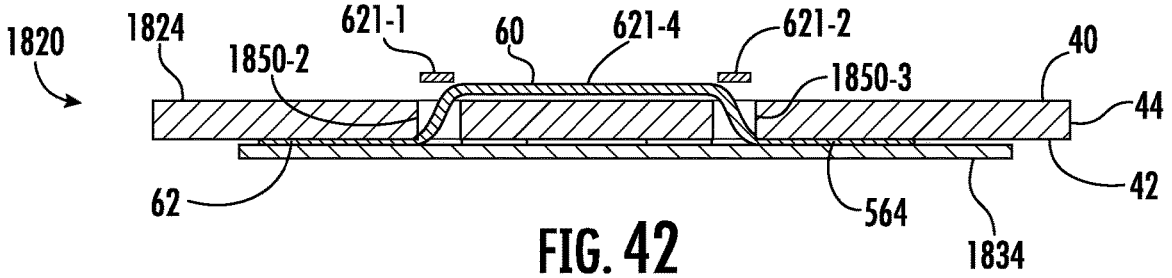
FIG. 42 is a sectional view of the attachment system of FIG. 41 taken along line 42-42.
Figure 43:
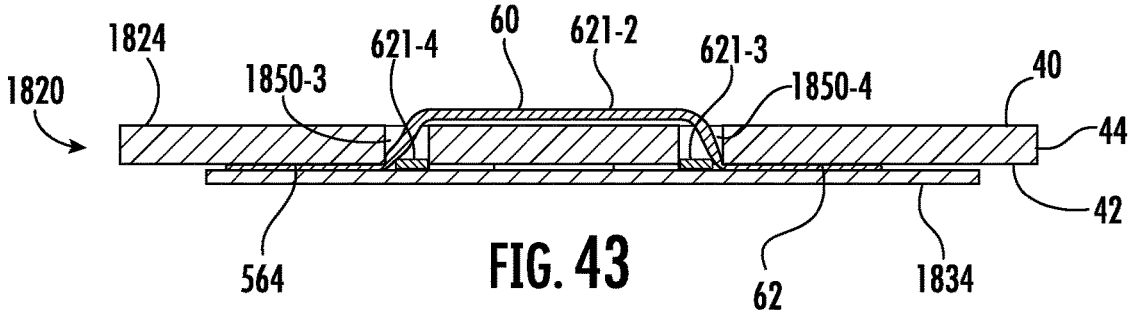
FIG. 43 is a sectional view of the attachment system of FIG. 41 taken along line 43-43.
Figure 44:
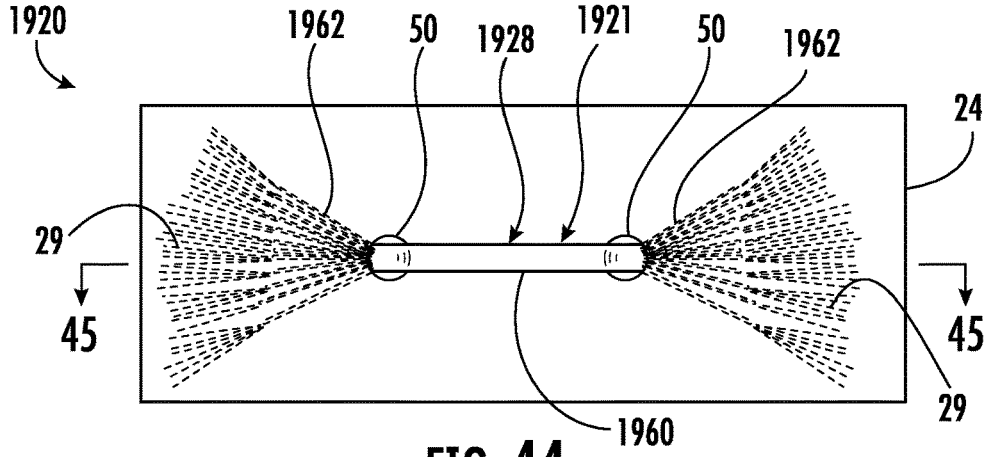
FIG. 44 is a top view illustrating portions of an example attachment system.
Figure 45:
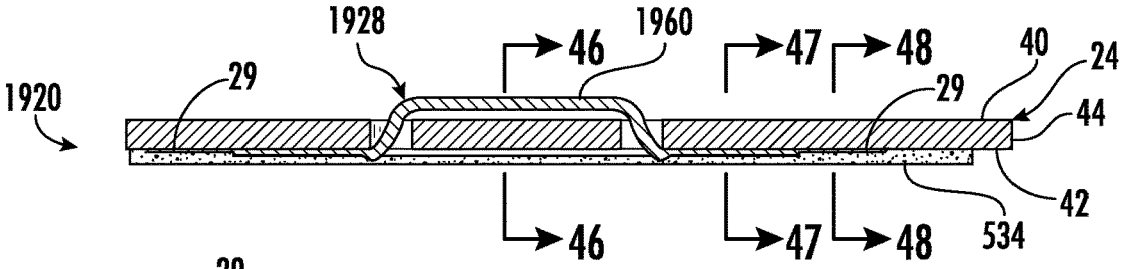
FIG. 45 is a sectional view of the attachment system of FIG. 44 taken along line 45-45.

After passing through such openings 1850, the bundled portions 60 transition to splayed portion 62 and 564 along face 42 of panel 1824. As shown by FIGS. 42 and 43, a single bond layer 1834 extends along face 42, sandwiching the splayed portions 62 and 564 of each of loop connectors 621 between layer 1834 and face 42 of panel 1824. Bond layer 1834 may be similar to bond layer 34 described above. In some implementations, splayed portion 62 and 564 of the different loop connectors 621 may be secured to face 42 by distinct bond layers. In other implementations, the splayed portions 62 and 564 may be secured to face 42 in other fashions, such as those fashions described above with respect to FIGS. 10-16.

As shown by FIG. 41, attachment system 1820 facilitates the securement of articles or other structures to panel 1824 along distinct, orthogonal axes. In the example illustrated, loop connectors 621-1 and 621-2 are spaced and extend parallel to one another such that a single strap 1825-1 may be passed between bundled portion 60 of loop connectors 621-1 and 621-2 and face 40 of panel 1824. Alternatively, or concurrently, a second strap 1825-2 may be passed between bundled portion 60 of loop connectors 621-3 and 621-4 and face 40 of panel 1824.

FIGS. 44-49 illustrate portions of an example attachment system 1920. FIGS. 44-49 illustrate an example of how the splayed strands may be bound to one another as sub bundles and how the strands of the sub bundles may be further separated and splayed. Attachment system 1920 comprises panel 24, loop connector 1921 and bond layer 534. Panel 24 and bond layer 534 are described above.

Loop connector 1921 is similar to loop connector 621 described in FIGS. 21 and 22 except that loop connector 1921 comprises a flexible length 1928 of strands 29 in place of the flexible length 28 of strands 29. Individual subsets of the overall number of individual strands 29 are bundled to form sub bundles 1961-1, 1961-2, 1961-3 and 1961-4 (collectively referred to as sub bundles 1961). Although the sub bundles 19611-1961-2 and 1961-3 are illustrated as including four individual strands 29 and sub bundle 1961-3 is illustrated as including three individual strands 29, such numbers are merely for purposes of illustration. As should be appreciated, each of such sub bundles may each include a fewer or greater number of individual stands 29 grouped and bundled together. The individual strands 29 of each individual sub bundles 1961 may be bundled in various fashions.

In the example illustrated, the individual strands 29 of sub bundle 1961-1 comprised tow (loose, parallel strands or fibers) about which a sleeve or sheath extends. In some implementations, the sleeve or sheath is wrapped about the individual strands 29. In some implementations, the sleeve or sheath may be heat shrunk about the individual strands 29. In some implementations, the individual strands 29 may simply pass through the hollow interior of a tubular sheath.

In the example illustrated, the individual strands 29 of sub bundle 1961-2 are bundled by being woven, braided, twisted, bonded or fused to one another, wherein the individual strands 29 are further bundled by an outer sheath or tube. The bonding of the individual strands 29 to one another may be through the application of an outer film of an adhesive about the individual strands 29 or the application of an adhesive that extends between the individual strands 29, joining the individual strands. The fusing of the individual strands to another may be through the application of heat, causing exterior surface portions of the strands to melt and fuse to one another. The outer sheath or tube may be wrapped about the individual strands, may comprise a tube through which the individual strands 29 passed, and such or may be heat shrunk about the individual strands 29. In some implementations, the individual strands 29 may be bonded to one another or fused to one another and then further bundled within the outer sheath or tube.

In the example illustrated, the individual strands 29 of sub bundle 1961-3 are bundled by being braided, woven, twisted, fused or bonded to one another, without an outer sheath or tube. Likewise, the individual strands 29 of sub bundle 1961-4 are bundled by being braided, woven, twisted, fused or bonded to one another, without an outer sheath or tube. As shown by such figures, the individual strands 29 of the various sub bundles 1961 may differ in size and number. Such a visual strands 29 may further differ in material composition.

Figure 46:
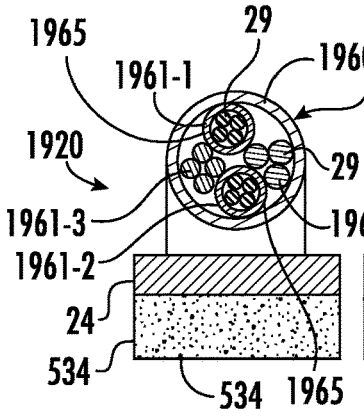
FIG. 46 is a sectional view of the attachment system of FIG. 45 taken along line 46-46.

As shown by FIG. 46, the multiple sub bundles 1961 are then themselves bundled together to form bundled portion 1960 of the flexible length 1928. Bundled portion 1960 extends along face 40 of panel 24, between openings 50. In the example illustrated, bundled portion 1960 passes through each of openings 50 to the backside 42 of panel 24. In some implementations, flexible length 1928 may comprise a kernmantle rope, wherein ends of the rope are splayed, to at least some degree, to form splayed portions which are secured to face 42 of panel 24.

Figure 47:
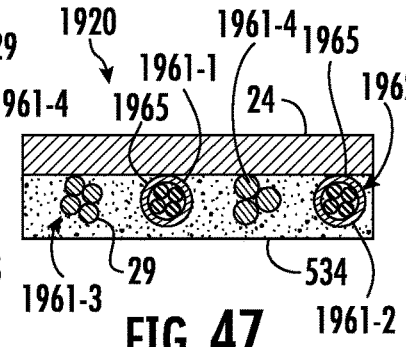
FIG. 47 is a sectional view of the attachment system of FIG. 45 taken along line 47-47.

As shown by FIG. 47, the bundled 1960 of flexible length 1928 undergoes a first splaying such that sub bundles 1961 are splayed along face 42 to form first splayed portions 1962. In each of the splayed portions 1962, the individual strands 29 remained grouped as sub bundles 1961 but are also splayed across face 42. For example, strands 29 of sub bundle 1961-1 are splayed with respect to the strands 29 of sub bundles 1961-2, 1961-3 and 1961-4. The same applies for the individual strands 29 of sub bundles 1961-2, 1961-3 in 1961-4.

Figure 48:
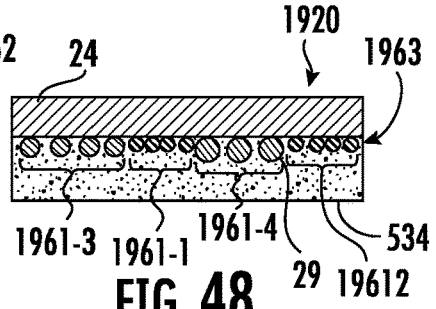
FIG. 48 is a sectional view of the attachment system of FIG. 45 taken along line 48-48.
Figure 49:
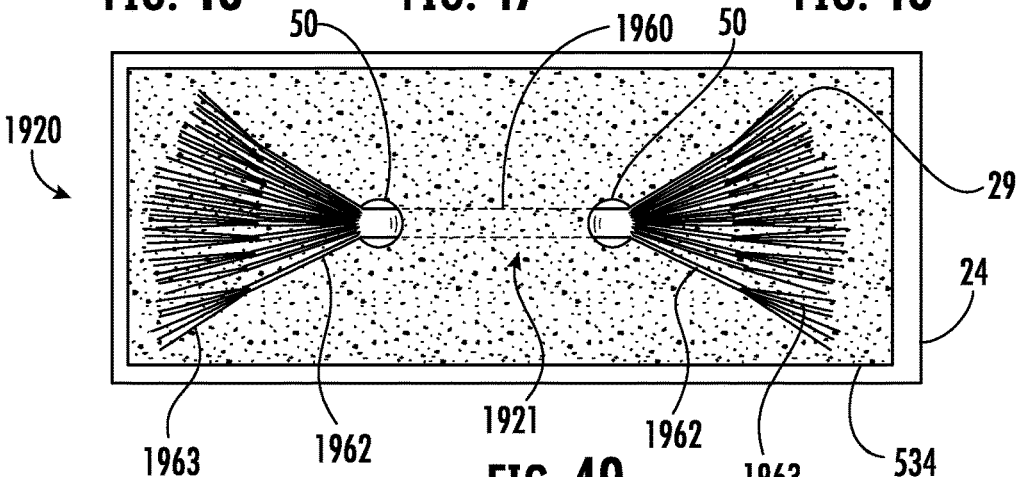
FIG. 49 is a bottom view illustrating portions of the example attachment system of FIG. 44.

As shown by FIG. 48, in some implementations, the individual sub bundles 1961 may undergo a second splaying such that the individual strands 29 of each sub bundle 1961 are further separated, spread apart and splayed relative to one another along face 42 to form second splayed portions 1963. Although each of the individual strands 29 of each of the sub bundles 1961 is illustrated as being splayed in FIGS. 44 and 48, in some implementations, a portion of the sub bundles 1961 may be splayed while a portion of the sub bundles 1961 remain intact as sub bundles. In some implementations, the sub bundles 1961 may not undergoing further splaying such that attachment system 1920 omits splayed portions 1963, relying upon the strength (and flatness) provided by the splaying of sub bundles 1961 as shown in FIG. 47. In some implementations, the opposite end 1960 may undergo both the first splaying and the second splaying such that the bundled portion 1960 shown in FIG. 46 immediately transitions to the splayed portion shown in FIG. 48 on the second face 42, omitting splayed portion 1962. Said another way, each individual strands 29 of the flexible length 28 is spread apart and splayed relative to all of the other individual strands 29, without any bundling or grouping, on face 42. In those implementations where the sub bundles may include outer sheets or tubes, the outer sheath or tubes of the sub bundles 1961 may be removed prior to the splaying (spreading apart or fanning out) of the individual strands 29 of the sub bundles 1961.

Bond layer 534 extends along face 42, sandwiching the splayed portions 1962 in 1963 of loop connector 1921 between layer 534 and face 42 of panel 1824. Bond layer 534 may be similar to bond layer 34 described above. In some implementations, the splayed portions on opposite ends of bundled portion 1960 may be secured to face 42 by distinct bond layers. In other implementations, the splayed portions 1962 and 1963 may be secured to face 42 in other fashions, such as those fashions described above with respect to FIGS. 10-16.

The splayed portions of the strands 29 forming portion 62 are bonded, directly or indirectly, to the second face 42. The splayed portions of the strands 29 forming portions 1962 in 1963 extend opposite to and across a larger surface area of the panel 24 as compared to a width of the bundled portions of the strands 29 forming portion 1960. This larger surface area provides a stronger connection to the panel 24 and offers a flatter profile across the face 42 of the panel 24. In some implementations, the first bundled portion 1960 of the flexible length of strands 29 has a maximum width lying in a first plane, on a first side of the panel 24, parallel to the first face 40 the panel 24 (diameter of a cylinder or transverse width of a flat band), wherein the second portions of splayed strands 29 forming portion 1962 and extending from the first bundled portion 1960 have a second maximum width lying in a second plane 65, on a second side of the panel 24, parallel to the first plane, that is greater than the first maximum width. The second maximum width is defined as the largest with of the fan of splayed strands, the spacing between two of the splayed strands that are spread apart from one another by the largest distance. In some implementations, the second maximum width is at least five times the first maximum width. In some implementations, the second maximum width is at least 20 times the first maximum width.

FIGS. 44-49 illustrate an example attachment system where the flexible length of strands 1928 comprises bundled sub bundles of individual strands, wherein opposite ends of the flexible length of strands 1928 undergo first splaying or spreading apart of the individual sub bundles (as shown in FIG. 47) and wherein the splayed or spread apart some bundles undergo a second splaying, splaying of spreading apart the individual strands 29 of the individual sub bundles. For purposes of this disclosure, the "splaying" of the flexible length of strands may refer to the splaying of individual strands 29 that remain grouped as sub bundles (as shown in FIG. 47), the splaying of individual strands 29 of a splayed sub bundle (as shown in FIG. 48), the splaying of individual strands 29 of a bundled sub bundle (transitioning directly from the state shown FIG. 46 to the state shown in FIG. 48) or the splaying (fanning or spreading apart) of individual strands 29 that are not grouped as sub bundles, but are all grouped together as a single bundle forming a bundled portion 60.

Although attachment systems 20, 120, 220, 320, 420 and each of the loop connectors of each of the attachment systems described in FIGS. 17-43 may be described in the context of a group of parallel individual strands 29 forming a single bundle portion 60, the flexible lengths of strands may alternatively comprise a flexible length 1928 having a group of sub bundles that are bundled along face 40, (1) wherein the individual fibers 29 of the sub bundles are splayed (while remaining intact as sub bundles) along face 42, (2) wherein the individual sub bundles are splayed or spread apart along face 42, (3) wherein the individual sub bundles are splayed or spread apart along face 42 and wherein the individual strands of the individual sub bundles are further splayed or spread apart along face 42, or (4) wherein the sub bundles are broken and the individual strands 29 of the unbundled sub bundles are splayed or spread apart across face 42 without any (or a fewer number of) sub bundles extending across face 42. As discussed above, in whatever form, the splayed sub bundles of strands and/or splayed strands are secured to face 42 by one or more bond layers.

In each of the above-described examples, the bundled portions of strands of each flexible length pass through the openings through the panel 24, 1524, 1624, 1724 and are then unbundled and splayed across the opposite face of the panel. The bundled strands extending through the openings may be less likely to tear or degrade when rubbing against the edges of such openings. In other implementations, unbundled strands may extend through such openings.

Although the present disclosure has been described with reference to example implementations, workers skilled in the art will recognize that changes may be made in form and detail without departing from the disclosure. For example, although different example implementations may have been described as including features providing diverse benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. An attachment system comprising:

a panel having a first face, a second face, an edge between the first face and the second face, and a first opening extending through and non-parallel to the first face and the second face;

a flexible length of strands extending through the first opening, the flexible length of strands comprising:

a first portion of the length extending along the first face and comprising bundled portions of the strands; and a second portion of the flexible length extending from the first portion along the second face, the second portion comprising splayed portions of the strands.

2. The attachment system of claim 1, wherein the flexible length of strands is selected from a group of flexible lengths of strands consisting of: a strap, a cord and a rope.

3. The attachment system of claim 1, wherein the bundled portions of the strands are woven, braided, wound, bonded, fused, or wrapped.

4. The attachment system of claim 1 further comprising a bonding layer laminated to the second face with the splayed portions of the strands being sandwiched between the bonding layer and the second face.

5. The attachment system of claim 4, wherein the bonding layer comprises a layer of fluid material that has solidified while encapsulating the splayed portions of the strands.

6. The attachment system of claim 4, wherein the bonding layer comprises a film supporting an adhesive, wherein the splayed portions of the strands are captured between the film and the second face.

7. The attachment system of claim 4 further comprising a second bonding layer laminated on the second face and adhered to the splayed portions of the strands which are captured between the bonding layer and the second bonding layer.

8. The attachment system of claim 4, wherein the flexible length of strands further comprises a third portion comprising splayed portions of the strands extending from the first portion on a side of the first portion opposite the second portion, the third portion extending along the second face and sandwiched between the second face and the bonding layer.

9. The attachment system of claim 8, wherein the panel comprises a second opening extending through and nonparallel to the first face and the second face.

10. The attachment system of claim 9, wherein the first portion extends over and across portions of the first face between the first opening and the second opening.

11. The attachment system of claim 8, wherein the panel comprises:

a third opening extending through and nonparallel to the first face and the second face; and a fourth opening extending through and nonparallel to the first face and the second face, wherein the attachment system further comprises:

a second flexible length of second strands extending through the third opening and through the fourth opening, the second flexible length of strands comprising:

a fourth portion comprising bundled portions of the second strands along the first face and extending parallel to the first portion the flexible length of strands, the fourth portion and the first portion forming first and second aligned openings, respectively, extending parallel to the first face;

a fifth portion comprising splayed strands, extending from the fourth portion and extending along and secured to the second face; and a sixth portion comprising splayed strands, extending from of the fifth portion on a side of the fourth portion opposite the fifth portion, the sixth portion being secured to the second face.

12. The attachment system of claim 11 further comprising:

a third flexible length of third strands extending through the first opening and through the fourth opening, the third flexible length of strands comprising:

a seventh portion comprising bundled portions of the third strands along the first face and extending perpendicular to the first portion the flexible length of strands;

an eighth portion comprising splayed strands, extending from the seventh portion and extending along and secured to the second face; and a ninth portion comprising splayed strands, extending from the seventh portion on a side of the seventh portion opposite the eighth portion, the ninth portion being secured to the second face;

a fourth flexible length of third strands extending through the second opening and through the third opening, the fourth flexible length of strands comprising:

a tenth portion comprising bundled portions of the fourth strands along the first face and extending parallel to the seventh portion the third flexible length of strands;

an eleventh portion comprising splayed strands extending from the tenth portion and extending along and secured to the second face; and a twelfth portion comprising splayed strands extending from the tenth portion on a side of the tenth portion opposite the eleventh portion, the tenth portion being secured to the second face.

13. The attachment system of claim 11 further comprising a strap passing through the first and second aligned openings.

14. The attachment system of claim 13 further comprising:

a second panel having a third face, a fourth face, a second edge between the third face and the fourth face, fifth opening extending through and non-parallel to the third face and the fourth face, and a sixth opening extending through and non-parallel to the third face and the fourth face;

a third flexible length of third strands extending through the fifth opening and the sixth opening, the third flexible length of strands comprising:

a seventh portion comprising bundled portions of the third strands along the third face and forming a third opening extending parallel to the first face; and an eighth portion comprising splayed portions of the third strands extending from the seventh portion and along the fourth face;

a ninth portion comprising splayed portions of the third strands extending from the seventh portion on a side of the seventh portion opposite the eighth portion, the ninth portion extending along the fourth face; and a third bonding layer laminated to the fourth face with the splayed portions of the third strands of the eight portion and the ninth portion sandwiched between the third bonding layer and the fourth face, wherein the strap passes through the third opening extending parallel to the first face.

15. The attachment system of claim 11, wherein the panel forms an article selected from a group of articles consisting of: a pack and a garment.

16. The attachment system of claim 8, wherein the panel comprises:

a third opening extending through and nonparallel to the first face and the second face; and a fourth opening extending through and nonparallel to the first face and the second face, wherein the flexible length of strands extends through the third opening and the fourth opening and further comprises:

a fourth portion extending from the third portion, comprising bundled portions of the strands, and extending along the first face of the panel; and a fifth portion extending from the fourth portion, comprising bundled portions of strands and extending along the second face of the panel;

wherein the attachment system further comprises a second bonding layer laminated to the second face of the panel with the splayed portions of the strands of the fifth portion sandwiched between the second bonding layer and the second face.

17. The attachment system of claim 16, wherein the bonding layer and the second bonding layer are part of a larger continuous bonding layer.

18. The attachment system of claim 16, wherein the first portion and the fourth portion cooperate with the panel to form first and second non-contiguous parallel openings, respectively.

19. The attachment system of claim 1, wherein the flexible length of strands is elastic.

20. The attachment system of claim 1, wherein the panel comprises a melted portion that has solidified while in contact with the splayed portions of the strands.

21. The attachment system of claim 1, wherein the strands of the flexible length of strands are first bundled to form the first portion, are then splayed to form the second portion and are then bundled to form a third portion of the flexible length extending from the second portions of the strands.

22. The attachment system of claim 1, wherein edge connects the first face and the second face, wherein the opening has a first mouth only on the first face and a second mouth only along the second face, and wherein the flexible length extends along the first face on a first side of the panel, bends into and through the first mouth, passes through the opening and along an entire thickness of the panel, and bends through and out of the second mouth before extending along the second face on a second side of the panel.

* * * * *